US009032917B1

(12) United States Patent
McNitt

(10) Patent No.: US 9,032,917 B1
(45) Date of Patent: May 19, 2015

(54) BARREL CAM ROTATING CYLINDER ENGINE

(76) Inventor: Mark McNitt, Buffalo, MN (US)

( * ) Notice: Subject to any disclaimer, the term of this patent is extended or adjusted under 35 U.S.C. 154(b) by 192 days.

(21) Appl. No.: 13/452,834

(22) Filed: Apr. 21, 2012

Related U.S. Application Data

(60) Provisional application No. 61/478,026, filed on Apr. 21, 2011.

(51) Int. Cl.

| | |
|---|---|
| ***F01B 13/04*** | (2006.01) |
| ***F02B 57/00*** | (2006.01) |
| ***F02B 75/36*** | (2006.01) |
| ***F02B 75/24*** | (2006.01) |
| ***F02B 75/18*** | (2006.01) |
| ***F02B 75/22*** | (2006.01) |
| ***F01B 3/00*** | (2006.01) |
| *F02B 25/08* | (2006.01) |

(52) U.S. Cl.
CPC . *F01B 3/00* (2013.01); *F02B 25/08* (2013.01); *F02B 2720/257* (2013.01); *F02B 2730/018* (2013.01); *F02B 2730/02* (2013.01)

(58) Field of Classification Search
CPC ..... F02B 2730/02; F02B 2730/018; F02B 2720/257; F02B 25/08; F01B 3/00
USPC ..... 123/43 R, 197.1–197.2, 193, 45 R, 53.3, 123/53.6, 55.2, 55.7; 251/212
See application file for complete search history.

(56) References Cited

U.S. PATENT DOCUMENTS

| | | | | |
|---|---|---|---|---|
| 1,572,068 | A * | 2/1926 | Gould | 123/43 AA |
| 1,613,136 | A * | 1/1927 | Schieffelin | 123/63 |
| 3,598,094 | A * | 8/1971 | Odawara | 123/48 R |
| 5,215,045 | A | 6/1993 | Vadnjal | |
| 5,375,567 | A | 12/1994 | Lowi, Jr. | |
| 5,878,919 | A * | 3/1999 | Heggeland et al. | 222/214 |
| 6,089,195 | A | 7/2000 | Lowi, Jr. | |
| 6,170,443 | B1 | 1/2001 | Hofbauer | |
| 6,182,619 | B1 | 2/2001 | Spitzer et al. | |
| 6,250,264 | B1 | 6/2001 | Henriksen | |
| 6,305,335 | B1 | 10/2001 | O'Toole | |
| 6,779,494 | B1 | 8/2004 | Aswani | |
| 6,986,328 | B2 * | 1/2006 | Huettlin | 123/45 R |
| 7,004,121 | B2 | 2/2006 | Moe et al. | |
| 7,124,716 | B2 | 10/2006 | Novotny | |
| 2007/0234898 | A1 * | 10/2007 | Boyl-Davis et al. | 91/306 |

OTHER PUBLICATIONS

Gat, Gesellschaft für Antriebstechnik mbH, "Welcome to GAT", www.gat.mnb.de. 26 pages. Date created Sep. 16, 2011.
Roto Flux. pp. 58-59. (2010).
HPMC • HSMC Series., Multi-Port Rotary Unions. pp. 40-43. Date created May 27, 2011.

* cited by examiner

*Primary Examiner* — Kenneth Bomberg
*Assistant Examiner* — Deming Wan
(74) *Attorney, Agent, or Firm* — Patterson Thuente Pedersen, P.A.

(57) ABSTRACT

The present disclosure is directed toward implementations of internal combustion engines. The disclosure describes various embodiments of internal combustion engines where most of the internal elements rotate. Such engines allow for more efficient transfer of the energy created by combustion to the motive components of a vehicle such as wheels or propellers. One specific embodiment includes a rotating cylinder with a single piston which both reciprocates and rotates. The rotating motion of the piston is transferred to the cylinder, which in turn is connected to a driveshaft. Various embodiments of the invention employ differing numbers and configurations of pistons. All embodiments have the advantage of decreasing engine volume and increasing efficiency over traditional internal combustion engines.

10 Claims, 15 Drawing Sheets

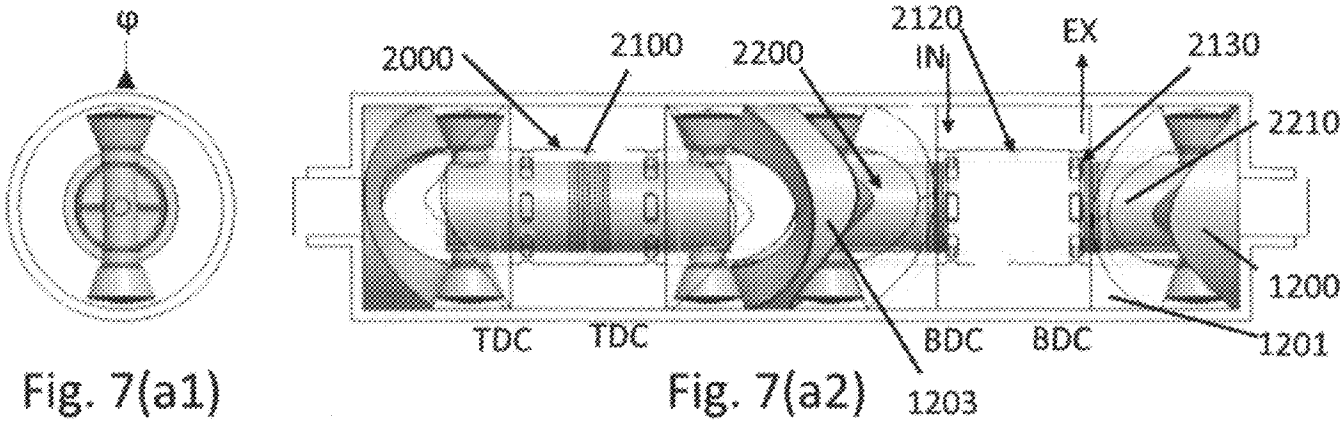
Fig. 7(a1)
Fig. 7(a2)
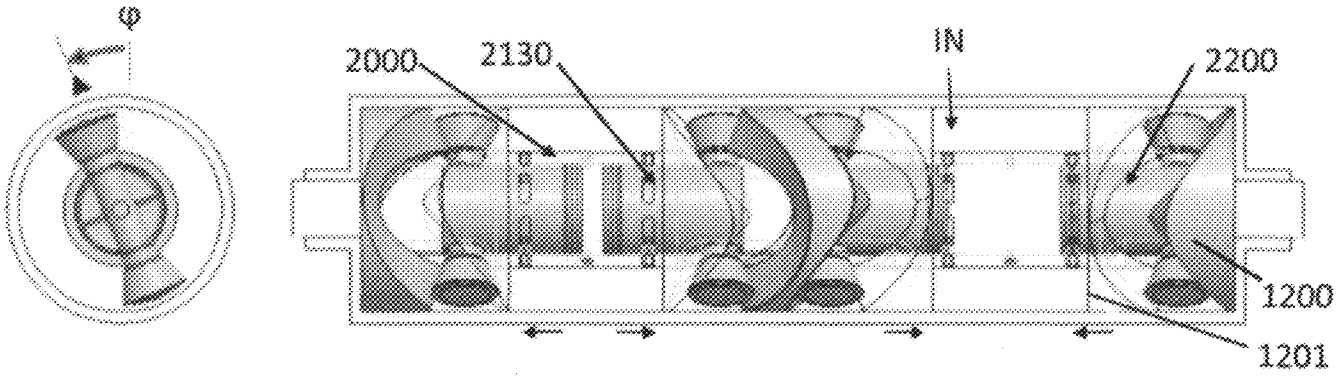
Fig. 7(b1)
Fig. 7(b2)

BARREL CAM ROTATING CYLINDER ENGINE

PRIORITY CLAIM

This application discloses and claims subject matter that is disclosed in applicant's U.S. provisional application Ser. No. 61/478,026 that was filed Apr. 21, 2011.

BACKGROUND OF THE INVENTION

Traditional two and four stroke internal combustion engines are employed in many different applications. One primary application is to provide power for the motive force in cars, boats, airplanes and other vehicles. These types of engines generally employ a relatively high number of moving components, including camshafts, crankshafts, connecting rods, crankpins, and more, to transfer the motion from one or more reciprocating pistons into rotational movement. All these moving parts result in friction losses that decrease the efficiency of the engine. The high component count also results in engines with high frontal areas.

Developing a two stroke engine with fewer components reduces the amount of energy lost to friction where each engine part contacts a separate engine part. Reducing the number of engine parts reduces these friction losses and results in an engine with greater fuel efficiency. Reducing the number of components also allows the engine to be lighter and more compact. Smaller, lighter engines are relatively more fuel efficient than larger, heavier engines. Development of smaller engines, and especially engines with smaller frontal areas, is especially important in the aircraft industry because of the drag produced by airplane engines with larger frontal areas.

BRIEF SUMMARY OF THE INVENTION

In accordance with a first aspect of the invention, an internal combustion engine is disclosed. The engine comprises an engine case and a rotating cylinder at least partially disposed within the engine case. The invention also includes one or more cam components connected to the engine case and are disposed around a portion of the rotating cylinder. The engine further includes reciprocating pistons which are at least partially disposed within the rotating cylinder. Cam path apertures are defined through the wall of the rotating cylinder. Cam rollers are connected to the reciprocating piston through the cam path apertures. The cam rollers are positioned adjacent to the cam components.

In one exemplary embodiment, the engine comprises two reciprocating pistons. The two reciprocating pistons may be positioned at least partially within the rotating cylinder and may be aligned within the rotating cylinder along a single axis. The reciprocating pistons may also be arranged to reciprocate in the same direction at the same time. In another exemplary embodiment, the two reciprocating pistons may be arranged to reciprocate in opposite directions at the same time.

A different exemplary embodiment comprises four reciprocating pistons. The four reciprocating pistons maybe positioned at least partially within the rotating cylinder and aligned within the rotating cylinder along a single axis. The reciprocating pistons may also be arranged to reciprocate in the same directions at similar times. In yet another exemplary embodiment, each of a pair of reciprocating pistons is arranged to reciprocate in the same directions at similar times and wherein each pair of reciprocating pistons are arranged to reciprocate in opposite directions at each time.

In another exemplary embodiment, the engine comprises three reciprocating pistons. The three reciprocating pistons maybe positioned at least partially within the rotating cylinder and aligned within the rotating cylinder along a single axis. The outer two reciprocating pistons may also be arranged to reciprocate in the same directions at similar times, while the third center reciprocating piston may be arranged to reciprocate in the opposite directions at similar times.

In another example embodiment, the cam components comprise a barrel cam, wherein the barrel cam has at least one curvilinear surface which defines a sinusoid.

Another embodiment of the present engine includes manifold ports defined through the wall of the rotating cylinder. Even yet another embodiment includes one or more fuel injection ports defined through the wall of the rotating cylinder.

Attendant the manifold ports, some embodiments include a manifold assembly. The manifold assembly may be comprised of a circular plate and a slotted circular plate. The two plates may be connected to each other such that the resulting component contains apertures which extend radially through the assembly. The final assembly may be disposed around the rotating cylinder adjacent to the manifold ports.

Further embodiments may include a rotating fuel injection system to inject fuel through the fuel injector ports. The rotating fuel injection system may include a nozzle and a segment connected to the nozzle configured to withstand high pressures. Between the two elements may be a valve. The rotating fuel injector assembly may further include a plunger rod positioned at an angle to the nozzle. The plunger rod may be configured to push fuel into the segment configured to withstand high pressures when the plunger is depressed. The plunger rod may also have a fuel injector cam roller connected to one end. Some embodiments also contain a fuel injector cam ring disposed around the fuel injector assembly. The fuel injector cam rollers may be configured to traverse the fuel injector cam ring as the rotating fuel injector assembly rotates. As the fuel injector cam rollers traverse the fuel injector cam ring, they may be configured to reciprocate the plunger rod. Further embodiments of the rotating fuel injector assembly may include an electrical slip ring. Even further embodiments of the rotating fuel injector assembly may include a rotary fluid coupling.

BRIEF DESCRIPTION OF THE DRAWING VIEWS

The invention is further described in connection with the accompanying drawings.

FIG. 1(*a*) is an isometric depiction of the disclosed single piston engine configuration.

FIG. 1(*b*) is an isometric depiction of a single piston engine configuration of the present invention, with one of the stationary cam components removed for a more clear view of the piston, its barrel cam rollers, and the cylinder with its slotted cam paths.

FIGS. 2(*a*1) and 2(*a*2) show a starting position of the cylinder, with the piston at the top dead center position.

FIGS. 2(*b*1) and 2(*b*2) show the relative position of the cylinder and piston after 45 degrees of rotation.

FIGS. 2(*c*1) and 2(*c*2) show the relative position of the cylinder and piston after 90 degrees of rotation, positioning the piston at the bottom dead center position.

FIGS. 2(*d*1) and 2(*d*2) show the relative position of the cylinder and piston after 135 degrees of rotation.

FIG. 3(*a*1) is an isometric depiction of the stationary manifold with respect to the other engine components.

FIG. 3(*a*2) is the same isometric depiction as FIG. 3(*a*1) with a portion of the manifold assembly cut away for clarity.

FIGS. 3(*b*1) and 3(*b*2) show the piston in a position just prior to the bottom dead center position, with the rotating cylinder manifold port apertures uncovered and lined up with frusto-pyramidal shaped slots in the manifold.

FIGS. 3(*c*1) and 3(*c*2) show the piston at the bottom dead center position, with the rotating cylinder manifold port apertures uncovered and partially lined up with frusto-pyramidal shaped slots in the manifold.

FIGS. 3(*d*1) and 3(*d*2) show the piston in a position just after the bottom dead center position, with the rotating cylinder manifold port apertures uncovered and lined up with frusto-pyramidal shaped slots in the manifold.

FIG. 4 illustrates the integration of direct injection for the engine of the present invention; FIGS. 4(*a*1) and 4(*a*2) show a unit direct injector reconfigured to fit within a smaller diametrical shape, the latter Figure having a portion of the injector removed for clarity.

FIGS. 4(*b*1) and 4(*b*2) show two such re-shaped unit direct injectors integrated so as to fit around the rotating cylinder, and depict how the cam roller assembly follows a modified cylindrical cam path and engages the fuel injector plunger.

FIGS. 4(*c*1) and 4(*c*2) isometrically depicts the integrated unit direct injection system, including the rotary fluid coupling and electrical slip ring.

FIG. 5 illustrates the operation of a dual combustion chamber, two piston engine configuration of the present invention arranged in a coaxial and tandem manner over one complete piston cycle, or one-half of a full cylinder rotation, the cylinder rotation being counterclockwise.

FIGS. 5(*a*1) and 5(*a*2) show a starting position of the cylinder, with the left piston at top dead center and the right piston at bottom dead center.

FIGS. 5(*b*1) and 5(*b*2) show the relative position of the cylinder and pistons after 45 degrees of rotation.

FIGS. 5(*c*1) and 5(*c*2) show the relative position of the cylinder and pistons after 90 degrees of rotation, positioning the left piston at bottom dead center and the right piston at top dead center.

FIGS. 5(*d*1) and 5(*d*2) show the relative position of the cylinder and pistons after 135 degrees of rotation.

FIG. 6 illustrates the operation of a dynamically balanced single cylinder, opposed piston engine configuration of the present invention over one complete piston cycle, or one-half of a full cylinder rotation, the cylinder rotation being counterclockwise.

FIGS. 6(*a*1) and 6(*a*2) show a starting position of the cylinder, with the pistons at top dead center.

FIGS. 6(*b*1) and 6(*b*2) show the relative position of the cylinder and pistons after 45 degrees of rotation.

FIGS. 6(*c*1) and 6(*c*2) show the relative position of the cylinder and pistons after 90 degrees of rotation, positioning the pistons at bottom dead center.

FIGS. 6(*d*1) and 6(*d*2) show the relative position of the cylinder and pistons after 135 degrees of rotation.

FIG. 7 illustrates the operation of the preferred embodiment of the engine of the present invention over one complete piston cycle, or one-half of a full cylinder rotation, the cylinder rotation being counterclockwise.

FIGS. 7(*a*1) and 7(*a*2) show a starting position of the cylinder, with intake and exhaust ports open in the right side of the cylinder assembly.

FIGS. 7(*b*1) and 7(*b*2) show the relative position of the cylinder, pistons, and intake and exhaust ports after 22.5 degrees of rotation.

FIGS. 7(*c*1) and 7(*c*2) show the relative position of the cylinder, pistons, and intake and exhaust ports after 45 degrees of rotation.

FIGS. 7(*d*1) and 7(*d*2) show the relative position of the cylinder, pistons, and intake and exhaust ports after 67.5 degrees of rotation.

FIGS. 7(*e*1) and 7(*e*2) show the relative position of the cylinder, pistons, and intake and exhaust ports after 90 degrees of rotation.

FIGS. 7(*f*1) and 7(*f*2) show the relative position of the cylinder, pistons, and intake and exhaust ports after 112.5 degrees of rotation.

FIGS. 7(*g*1) and 7(*g*2) show the relative position of the cylinder, pistons, and intake and exhaust ports after 135 degrees of rotation.

FIGS. 7(*h*1) and 7(*h*2) show the relative position of the cylinder, pistons, and intake and exhaust ports after 157.5 degrees of rotation.

Figure 9:
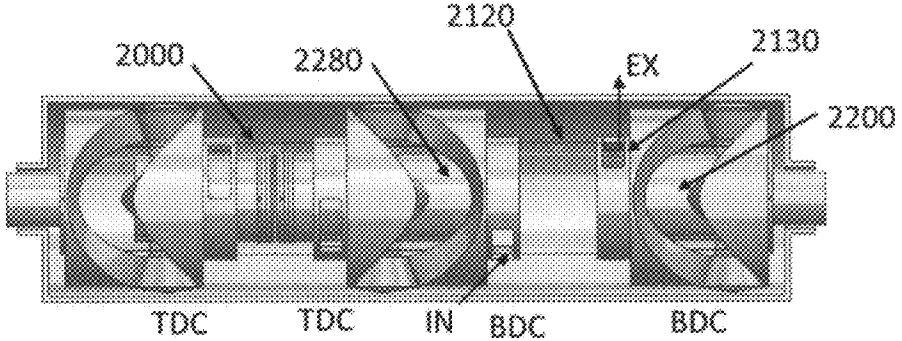
FIG. 9 illustrates the operation of a three piston version of the engine of the present invention over one complete piston cycle, or one-half of a full cylinder rotation, the cylinder rotation being counterclockwise.
Figure 9:
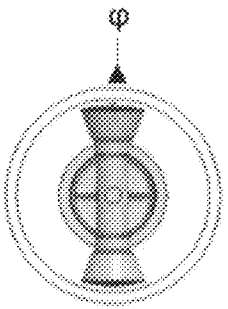
Figure 9:
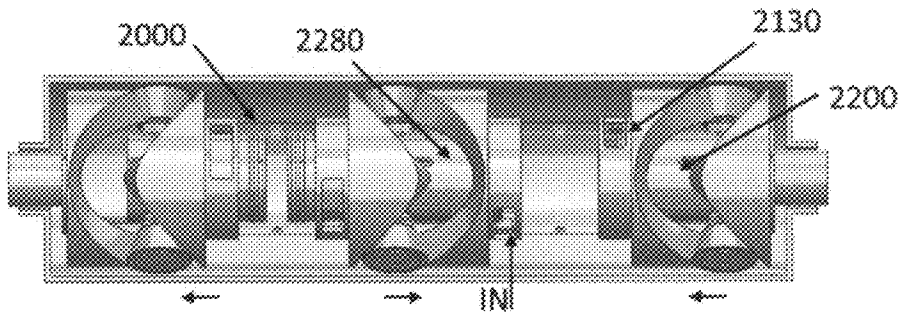
Figure 9:
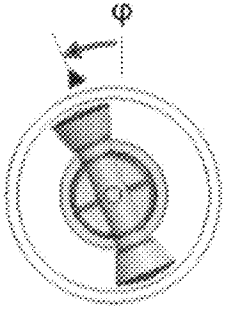
Figure 9:
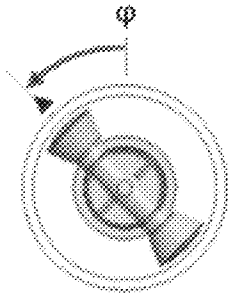
Figure 9:
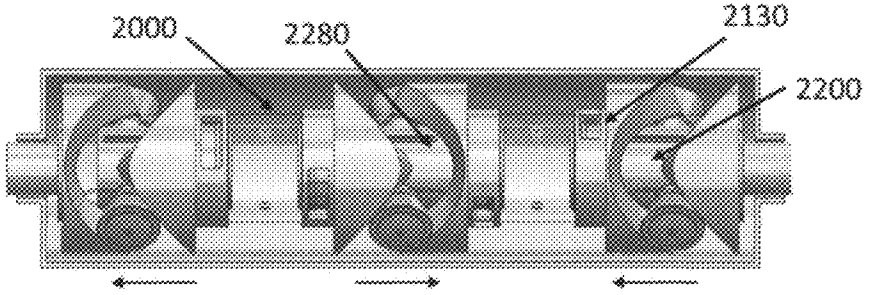
Figure 9:
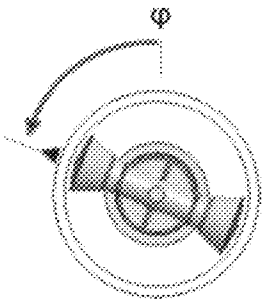
Figure 9:
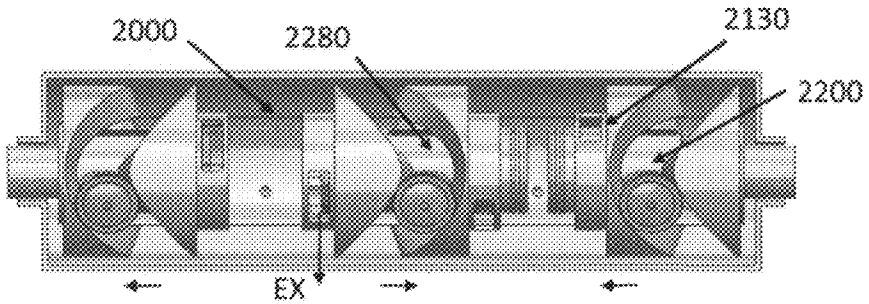
Figure 9:
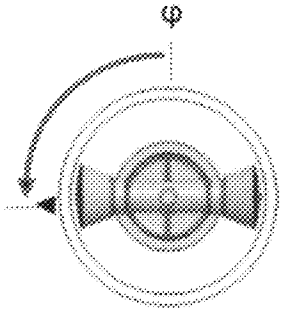
Figure 9:
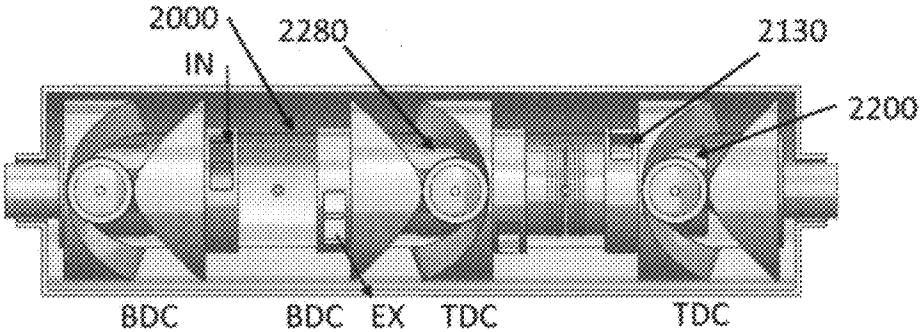
Figure 9:
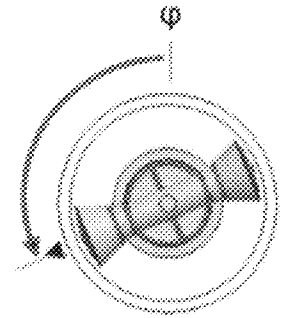
Figure 9:
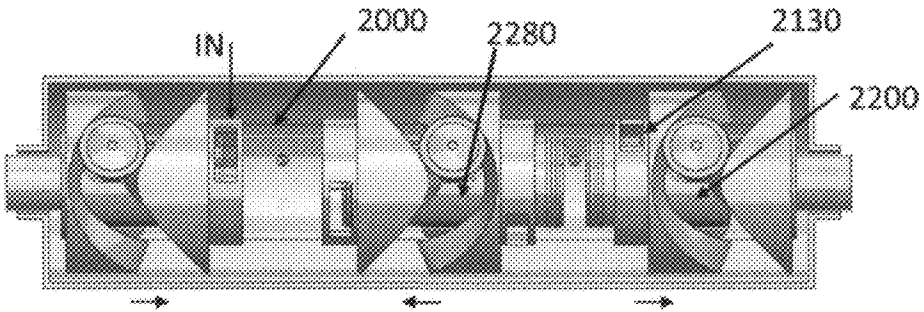
Figure 9:
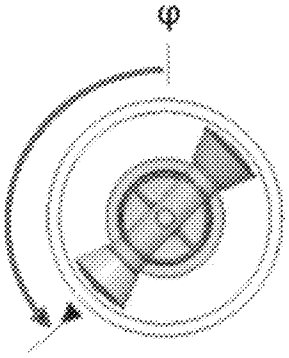
Figure 9:
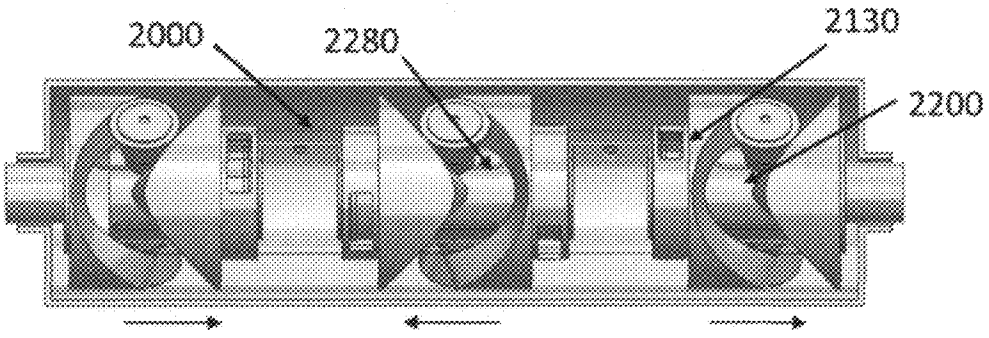
Figure 9:
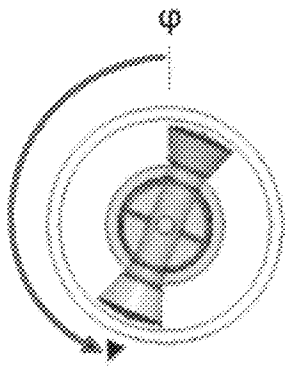
Figure 9:
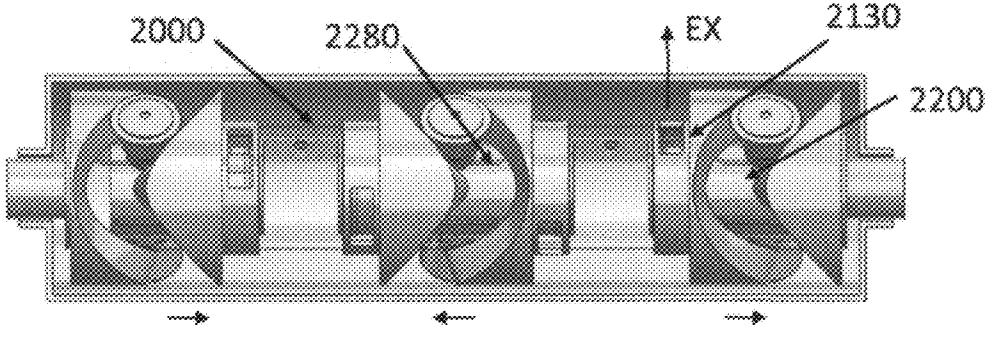

FIGS. 9(*a*1) and 9(*a*2) show a starting position of the cylinder, with intake and exhaust ports open in the right side of the cylinder assembly.

FIGS. 9(*b*1) and 9(*b*2) show the relative position of the cylinder, pistons, and intake and exhaust ports after 22.5 degrees of rotation.

FIGS. 9(*c*1) and 9(*c*2) show the relative position of the cylinder, pistons, and intake and exhaust ports after 45 degrees of rotation.

FIGS. 9(*d*1) and 9(*d*2) show the relative position of the cylinder, pistons, and intake and exhaust ports after 67.5 degrees of rotation.

FIGS. 9(*e*1) and 9(*e*2) show the relative position of the cylinder, pistons, and intake and exhaust ports after 90 degrees of rotation.

FIGS. 9(*f*1) and 9(*f*2) show the relative position of the cylinder, pistons, and intake and exhaust ports after 112.5 degrees of rotation.

FIGS. 9(*g*1) and 9(*g*2) show the relative position of the cylinder, pistons, and intake and exhaust ports after 135 degrees of rotation.

FIGS. 9(*h*1) and 9(*h*2) show the relative position of the cylinder, pistons, and intake and exhaust ports after 157.5 degrees of rotation.

DETAILED DESCRIPTION

Improved engine designs that include reduced numbers of parts, lower friction losses, reduced vibration, and smaller frontal area would greatly benefit automotive and aircraft applications. Frontal area reductions would be especially beneficial for aircraft applications, due to the reduced drag contribution of the engines and their cowlings. Traditional piston engine designs, with piston rods, crankshafts, and cam driven valves are inherently burdened by high part counts, sizable friction losses, and large frontal areas. Even advancements in rotary engines and opposed piston configurations continue to be limited in the efficiencies they can produce in many of these attribute areas.

A new engine configuration should be lighter in weight and preferably have a reduced frontal area profile for improved installation suitability. For automotive applications, a reduced frontal area profile would permit the engine to fit compactly in narrow spaces. For light aircraft applications, a reduced frontal area profile would reduce drag associated with large frontal area engine cowlings.

Compared to a current state-of-the-art production four cylinder in-line engine having comparable performance, the engine of the present invention provides previously unanticipated—yet substantial—improvements in frontal area, the reduction of friction losses and number of parts in the engine assembly, and the nearly complete elimination of vibration, due to the use of a rotating cylinder and barrel cam rollers.

Unless otherwise specified in this description, the components of the present invention may be made from metal including titanium, steel stainless steel, aluminum, or any other metal suitable for use in an internal combustion engine. Components may also be made from non-metallic materials, provided such materials possess properties suitable for the loads and temperatures typically present in engine applications. Additionally, unless otherwise specified in the description, when components are attached to each other, they may be attached using various welding techniques, with screws, nails, glue, or by any suitable technique for attaching metal or non-metal components to other metal or non-metal components.

1. General Description of Engine Components

Figure 1A:
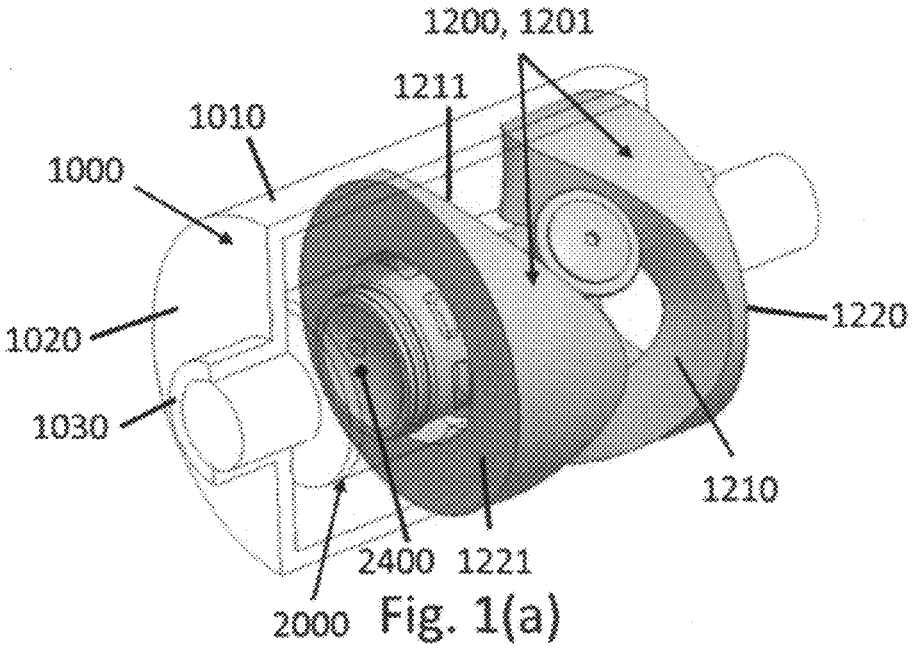
Figure 1B:
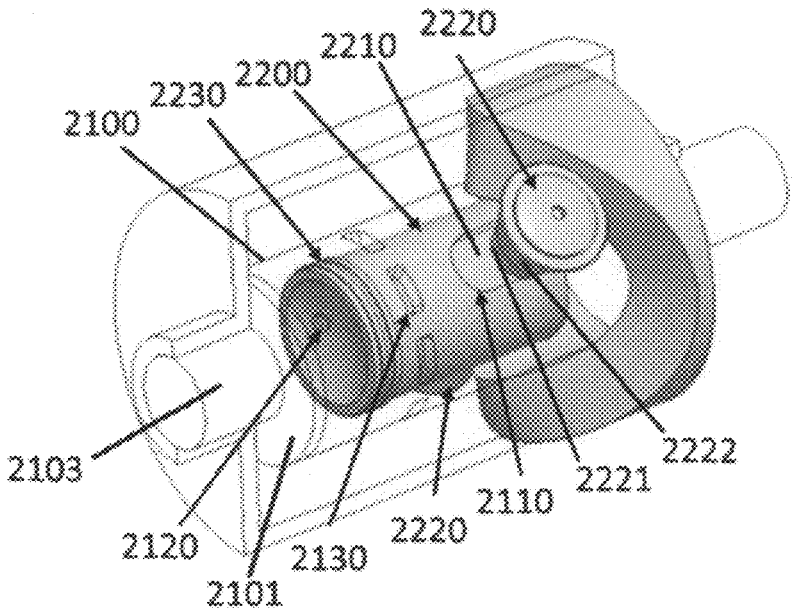

FIGS. 1(*a*) and 1(*b*) illustrate one exemplary embodiment of the present invention. One embodiment of the engine configuration of the present invention comprises a stationary engine case assembly 1000 (which has a portion of it cut away for clarity), and a rotating cylinder assembly 2000.

Stationary engine case 1000 comprises a hollow cylinder component 1010 and circular end components 1020. Stationary engine case 1000 may further comprise cylindrical end caps 1030. Hollow cylinder component 1010 may have apertures (not shown) defining holes through the walls of hollow cylinder component 1010. The apertures may allow for the intake and exhaust of air (the operation of which is described in further detail later) or the injection of fuel.

In one example embodiment, circular end components 1020 have circular openings near the center of circular end components 1020. Cylindrical end caps 1030 may be a hollow cylindrical component. Cylindrical end caps 1030 may be attached to circular end components 1020 such that the hollow center portion of cylindrical end caps 1030 line up with the circular openings of circular end components 1020. In some embodiments the circular openings in the circular end components 1020 and the center hollow portion of cylindrical end caps 1030 are the same size. In at least one embodiment, components 1030, 1020, and 1010 are made from a single piece of metal as a unitary component.

Stationary engine case 1000 may further comprise cylindrical cam components 1200 and 1201. Cylindrical cam components 1200 and 1201 may generally be metal cylinders with an aperture defined through each component's center. Further, each cylindrical cam component 1200 and 1201 has two different opposing ends 1210, 1220 and 1211, 1221 respectively. Surfaces 1220 and 1221 are flat, outer surfaces which face toward the circular end components 1020. Inner surfaces 1210 and 1211 face each other. In one embodiment, inner surfaces 1210 and 1211 are curvilinear in shape, with the surfaces defining peaks where the cylindrical cam components 1200 and 1201 are relatively thick and valleys where cylindrical cam components 1200 and 1201 are relatively thin. In one example embodiment, inner surfaces 1210 and 1211 define a sinusoidal shape of peaks and valleys.

Cylindrical cam components 1200 and 1201 may be disposed within hollow cylinder component 1010. In some embodiments, cylindrical cam components 1200 and 1201 are attached to hollow cylinder component 1010. In at least one embodiment, cylindrical cam components 1200 and 1201 are secured to hollow cylinder component 1010 through bolted or pinned connections. In one embodiment, the end surface 1221 of cylindrical cam component 1201 abuts one of the circular end components 1020. Cylindrical cam component 1201 may or may not be physically attached to circular end components 1020. In one embodiment, cylindrical cam component 1200 is positioned further toward the middle of the stationary engine case 1000 than cylindrical cam component 1201. In further embodiments, cylindrical cam components 1200 and 1201 are aligned such where inner surface 1210 defines a peak, adjacent inner surface 1211 defines a valley, and where inner surface 1211 defines a peak, adjacent inner surface 1210 defines a valley. In some embodiments, cylindrical cam components 1200 and 1201 are positioned apart from each other such that there is space between inner surfaces 1210 and 1211.

FIG. 1(*a*) and FIG. 1(*b*) also depict rotating cylinder assembly 2000. Rotating cylinder assembly 2000 has a rotating cylinder 2100, end caps 2101, and drive shafts 2103. Rotating cylinder 2100 is generally hollow with various apertures defined through its outer surface. In some embodiments, rotating cylinder 2100 has manifold port apertures 2130 defined through the wall of rotating cylinder 2100.

Manifold port apertures 2130 may be generally rectangular in shape. In other embodiments, the edges of the manifold port apertures 2130 angle inward toward the interior of rotating cylinder 2100, wherein the manifold port apertures 2130 generally define a frusto-pyramidal shape with an asymmetric base. Other embodiments contemplate different shaped apertures. In at least one embodiment, manifold port apertures 2130 are placed away from the region occupied by the cylindrical cam components 1200 and 1201 such that no portion of either cam component overlaps the ports 2130.

Rotating cylinder 2100 may further have at least one fuel injection port aperture 2120 defined through its wall. In some embodiments the rotating cylinder 2100 has two fuel injection port apertures 2120 which may be located on opposite sides of the hollow cylinder component 1010. Fuel injection port apertures 2120 may define a hole of any shape, but in at least one embodiment, the shape is round. Fuel injection port apertures 2120 may be positioned even further away from cylindrical cam components 1200 and 1201 than the manifold port apertures 2130.

One particular embodiment (not shown) of the present invention includes a single fuel injection port aperture 2120. In this embodiment the driveshaft 2103 furthest from the cylindrical cam components 1200 and 1201 has a hollow channel running through the driveshaft lengthwise. The hollow channel ends in fuel injection port aperture 2120 where the hollow channel opens up into the hollow portion of Rotating cylinder 2100.

Finally, rotating cylinder 2100 may include slotted cam path apertures 2110. One embodiment includes two slotted cam path apertures 2110 defined on opposing sides on rotating cylinder 2100. These slotted cam path apertures 2110 generally define a rectangular area where the two ends of the rectangle form semi-circles. These slotted cam path apertures 2110 may be located generally in the region where cylindrical cam components 1200 and 1201 encircle the Rotating cylinder 2100. In some embodiments, the slotted cam path apertures 2110 are located such that a portion of either cylindrical cam component 1200 or 1201 overlaps the slotted cam path apertures at all times during the operation of the invention.

FIG. 1(*a*) and FIG. 1(*b*) further depict reciprocating piston assembly 2200. Reciprocating piston assembly 2200 may include reciprocating piston 2210 and barrel cam rollers 2220. Reciprocating piston assembly 2200 may be positioned inside the hollow portion of rotating cylinder 2100. Barrel cam rollers 2220 may include straight roller elements 2221 and tapered barrel cam roller elements 2222. In at least one embodiment, reciprocating piston assembly 2200 includes two barrel cam rollers 2220 positioned on opposite sides of reciprocating piston 2210.

Reciprocating piston 2210 may be a standard engine piston that is well known in the art. Reciprocating piston 2210 may include a number of piston rings 2230. The exact number of piston rings included in the invention may range between 1 and 5. A person of ordinary skill in the art would know to use the number of piston rings that optimizes combustion chamber sealing, which may be readily determined through simple experimentation that is well known in the art. Additionally, as is known in the art, one end of reciprocating piston 2210 may have a variety of features that improve engine efficiency. For example, the end may have a concave or other hollow shaped portion.

The straight roller elements 2221 of reciprocating piston assembly 2200 may generally be cylindrical pieces of metal. In some embodiments, straight roller elements 2221 have a hollow channel running through their centers.

Tapered barrel cam roller elements 2222 may have a wide, circular top portion which tapers to a smaller, circular base portion. In general, this shape may be referred to as frusto-conical. The diameter of the base portions of tapered barrel cam roller elements 2222 may be the same size as the diameter of the straight roller elements 2221. Similar to straight roller elements 2221, tapered barrel cam roller elements 2222 may have a hollow channel running through its center. In one embodiment, when a tapered barrel cam roller element 2222 is positioned on top of a straight roller element 2221, the hollow channels of both components may line up to make a single, connected hollow channel.

In other embodiments, straight roller elements 2221 and tapered barrel cam roller elements 2222 may be formed together from a single element. In these embodiments, the single element has two different sections—a tapered section and a straight section, with the straight section having the same diameter as the diameter of the element where on the small end of the taper.

Barrel cam rollers 2220 are attached to reciprocating piston 2210 in a rotatably independent fashion. In one embodiment, at the point where barrel cam rollers 2220 are to be attached to reciprocating piston 2210, reciprocating piston 2210 has a round slot extending toward the center of the piston. In embodiments where two barrel cam rollers 2220 attach to reciprocating piston 2210, reciprocating piston 2210 may have two round slots on opposite sides of the piston. Further, both slots may extend to the center of the piston and connect such that the reciprocating piston 2210 has one long slot extending all the way through it. The slot may be sized such that when straight roller elements 2221 and tapered barrel cam roller elements 2222 are placed over the slot, the slot aligns with the hollow channels in the elements and forms a single, long, interconnected channel.

In some embodiments, pin elements may be press fit into or otherwise attached to the round slots in reciprocating piston 2210. Each pin would extend outwardly beyond the edge of the piston. Then, straight roller elements 2221 and tapered barrel cam roller elements 2222 may be slid over each pin. In one embodiment, each pin element would extend slightly beyond the end of the tapered barrel cam roller elements 2222. In these embodiments, a capping element may be fit over and attached to each pin. In this manner, straight roller elements 2221 and tapered barrel cam roller elements 2222 would be prevented from sliding off the pin. Through this connection, tapered barrel cam roller elements 2222 and straight roller elements 2221 would be able to rotate independent of the piston and of each other.

In embodiments where reciprocating piston 2210 has a single channel extending all the way through the element, there may be a single, long pin element. The pin element may be positioned in the channel in piston 2210 and extend beyond the opposed edges of the piston. In a manner similar to that described above, the straight roller elements 2221 and tapered barrel cam roller elements 2222 may be positioned over the pin element and capped.

Figure 3:
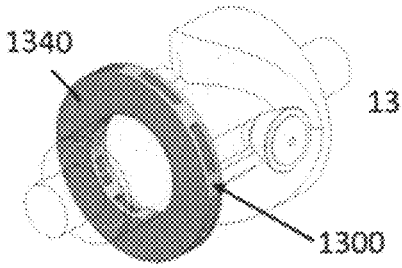
Figure 3:
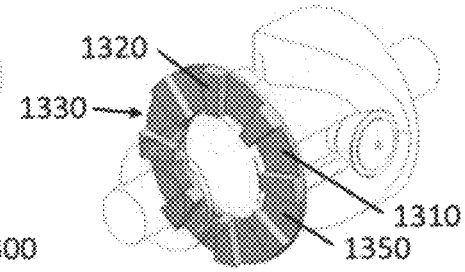
Figure 3:
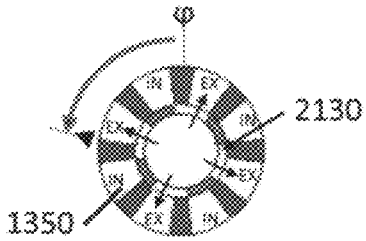
Figure 3:
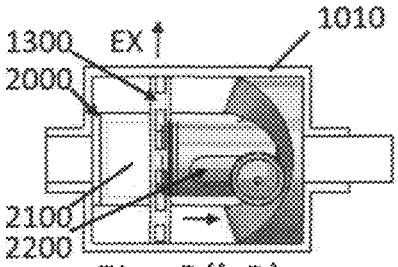
Figure 3:
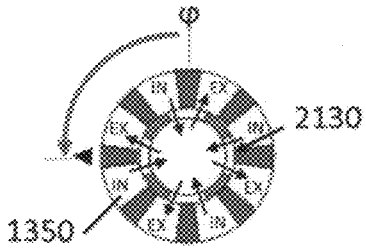
Figure 3:
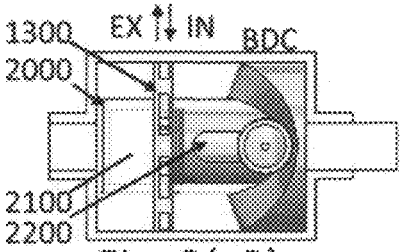
Figure 3:
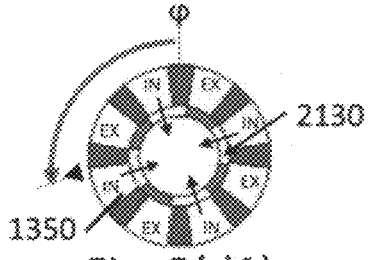
Figure 3:
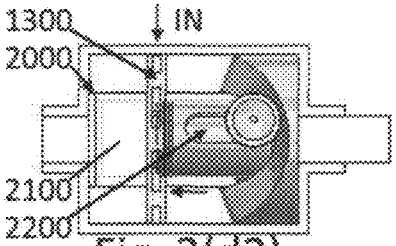

As depicted in FIGS. 3(*a*1)-3(*d*2), the present invention may further comprise a manifold assembly 1300. Manifold assembly 1300 may include slotted component 1330 and plate component 1340. Slotted component 1330 may be a circular plate with a circular aperture defined through its center comprised of flat portions 1310 and raised portions 1320. The flat portions 1310 and the raised portions 1320 may alternate circumferentially around the slotted component 1330. Raised portions 1320 may extend from the edge of the slotted component 1330 to its center aperture. In some embodiments, the raised portions 1320 are a frusto-pyramidal shape with the base near the outer edge of the slotted component 1330. Other embodiments contemplate the raised portions 1320 as other shapes.

The plate component 1340 may be attached to the slotted component 1330 with the plate component 1330 connected to the raised portions 1320 of component 1330. Once connected, components 1330 and 1340 comprise the manifold assembly 1300. The manifold assembly 1300 may then have a series of frusto-pyramidal shaped slots 1350 spaced apart around the circumference of the assembly. In other embodiments, manifold assembly 1300 may be made from a single component. In operation, the frusto-pyramidal shaped slots 1350 may be used as air intake and exhaust ports. In at least one embodiment, every other frusto-pyramidal shaped slot 1350 is used for air intake and the other the frusto-pyramidal shaped slots 1350 are used for air exhaust. In other embodiments, the intake frusto-pyramidal shaped slots 1350 and the exhaust frusto-pyramidal shaped slots 1350 may be different in number. In further embodiments, multiple manifold assemblies 1300 may be employed in a single engine, with each manifold assembly 1300 being responsible solely for intake or for exhaust. Additionally, the sequence of the ports may be different than every other. The invention contemplates all combinations of numbers and sequences of using frusto-pyramidal shaped slots 1350 as intake and/or exhaust ports.

Figure 4:
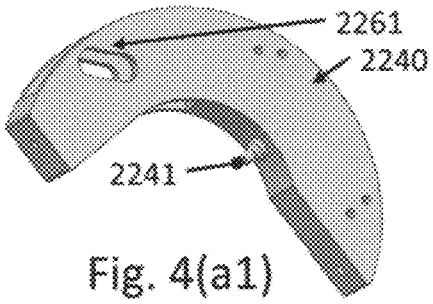
Figure 4:
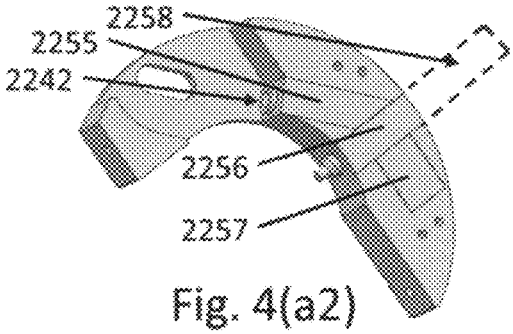
Figure 4:
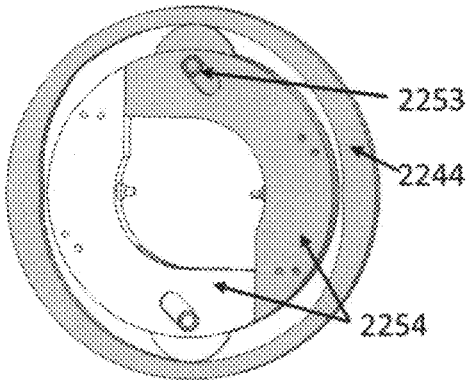
Figure 4:
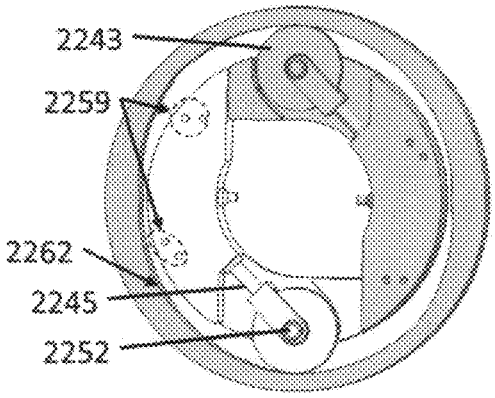
Figure 4:
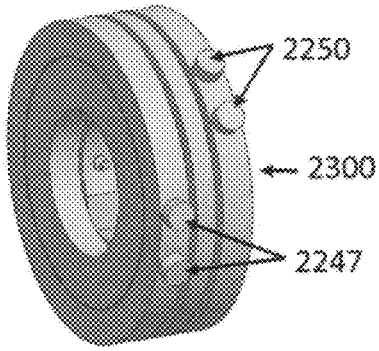
Figure 4:
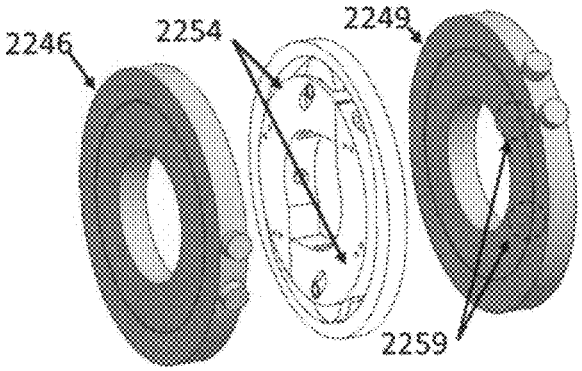

As depicted in FIGS. 4(*a*1)-4(*c*2), the present invention may further comprise an integrated unit direct injection system 2300. Integrated unit direct injection system 2300 may comprise single or multiple fuel injector assemblies 2254, which fasten to and rotate with the rotating cylinder 2100 (not shown). In such an embodiment, the nozzle assemblies 2241 of the fuel injector assemblies 2254 may be inserted into fuel injection port apertures 2120 (not shown). Integrated unit direct injection system 2300 may further comprise rotary fluid coupling 2246 and electrical slip ring 2249. A person of ordinary skill in the art would know to arrange concentric hollow cylindrical portions for each of the rotary fluid coupling 2246 and electrical slip ring 2249, the inner portions of which may be positioned around and rotate with the rotating cylinder 2100 and the outer portions of which may stay stationary with the stationary engine case 1000 (not shown). The outer portion of the rotary fluid coupling 2246 may have fluid connection ports 2247 that communicate with the rest of the engine's fuel delivery system, which may be configured in a typical manner common in the art. The outer portion of the electrical slip ring 2249 may have electrical connection ports 2250 that communicate with the rest of the engine's ignition system, which may be configured in a typical manner common in the art. The inner portions are in communication with the fuel injector assemblies 2254 so as to deliver fuel and electrical power to the injectors. Fuel ports and electrical connections 2259 may be configured in the rotary fluid coupling 2246 and electrical slip ring 2249 for transfer of fuel and electricity to and from the fuel injector assemblies 2240, which may also have fuel ports and electrical connections 2259 configured thereon. The sizing, sealing, function, and fastening of the various portions of the rotary fluid coupling 2246 and electrical slip ring 2249 may be readily determined through simple analysis and experimentation that are well known in the art.

Fuel injector assembly 2254 may comprise a unit injector 2240, which may further comprise a nozzle assembly 2241, plunger assembly 2242, pump assembly 2255, high pressure portion 2256, and solenoid assembly 2257. In some embodiments, the unit injector 2240 may be configured as a traditional unit injector with a shape and configuration which would be readily familiar to a person of ordinary skill in the art. In such an embodiment, the traditional unit injector's plunger and fuel pump portion 2258 would be aligned with the nozzle assembly 2241 and high pressure portion 2256. Another embodiment may instead arrange the pump assembly 2255 at an angle to the nozzle assembly 2241 and high pressure portion 2256 so as to minimize the radial space occupied by the rotating assembly. In such an embodiment, fuel injector assembly 2254 may further comprise fuel injector cam slots 2261 that may be oriented in the direction of the pump assembly 2255. This embodiment of the fuel injector assembly 2254 may also comprise fuel injector plunger rod 2245, which may have a rod shape at one end that may press upon the plunger assembly 2242 and a yoke configuration on its other end. Such fuel injector plunger rod 2245 may also have cylindrical apertures on the yoke end. The fuel injector assembly 2254 may further comprise fuel injector cam roller 2243, which may have a bushing or bearing at its inner diameter interface, and which may further be positioned within the yoke of the fuel injector plunger rod 2245. Some embodiments of the fuel injector assembly 2254 may further comprise fuel injector roller pin 2252, which may be press fit into either the yoke assembly of the fuel injector plunger rod 2245, the fuel injector cam roller 2243, or both. Other exemplary fuel injector assemblies 2254 may also comprise one or more fuel injector secondary rollers 2253 that may have a bushing or bearing within its inner diameter and which may be positioned onto the fuel injector roller pin 2252 through a press fit or other fastening method, and may further be positioned with its outer diameter aligned with and rolling upon the fuel injector cam slots 2261 of the fuel injector assembly 2254.

In some embodiments of the integrated unit direct injection system 2300, a fuel injector cam ring 2244 may be placed around the fuel injector assembly 2254. In at least one embodiment, fuel injector cam ring 2244 may be hollow, with the internal hollow portion configured as a fuel injector cam surface 2262 which fuel injector cam roller 2243 may roll upon. A person of ordinary skill in the art would know to configure fuel injector cam surface 2262 in a manner that would allow integrated unit direct injection system 2300 to be pressurized appropriately as fuel injector cam roller 2243 embodied as described rolls upon fuel injector cam surface 2262 during rotation of cylinder assembly 2100.

2. Combination of the Assemblies

The rotating cylinder assembly 2000 may be disposed within the stationary engine case assembly 1000. The cylindrical cam components 1200 and 1201 may be situated around the rotating cylinder 2100, but are not connected to the cylinder. Instead, there may be a small space between components 1200, 1201 and 2100 so as to allow rotating cylinder 2100 to rotate during the operation of the engine. The cylindrical cam components 1200 and 1201 are disposed about rotating cylinder 2100 near the slotted cam path apertures 2110.

In at least one embodiment, the reciprocating piston 2210 is positioned inside of the rotating cylinder 2100. The outer diameter size of the reciprocating piston 2210 relative to the internal diameter of the rotating cylinder 2100 may be similar to sizes well know in the art for other internal combustion engines pistons and engine block cavities.

When the reciprocating piston 2210 is positioned inside the rotating cylinder 2100, the engine assembly defines a combustion chamber 2400, as shown in FIG. 1(*b*). The combustion chamber 2400 is analogous to combustion chambers in standard internal combustion engines.

The round slots extending internally to reciprocating piston 2210 may line up with the slotted cam path apertures 2110 of the rotating cylinder 2100. As described above, the barrel cam rollers 2220 may be attached to the reciprocating piston 2210. Some embodiments may include a friction reducing element placed between straight roller elements 2221 and tapered barrel cam roller elements 2222 to reduce the friction forces on the elements as they rotate independently. In at least one embodiment, the straight roller elements 2221 are the same thickness as the wall of the rotating cylinder 2100. In other embodiments, straight roller elements 2221 may be thinner or thicker than the wall of the rotating cylinder 2100.

The round slots in the reciprocating piston 2210 and the slotted cam path apertures 2110 may be aligned with the cylindrical cam components 1200 and 1201 such that when the barrel cam rollers 2220 are attached to the reciprocating piston 2210 through the slotted cam path apertures 2110, the barrel cam rollers 2220 fit between the cylindrical cam components 1200 and 1201. The cylindrical cam components 1200 and 1201 may be spaced apart a distance about equal to the diameter of the largest diameter section of the tapered barrel cam roller elements 2222. The curvilinear surfaces of the cylindrical cam components 1200 and 1201 and the tapered barrel cam roller elements 2222 may be configured in such a way that the surface of the tapered barrel cam roller elements 2222 may be in substantial contact with the curvilinear surfaces of the cylindrical cam components 1200 and 1201 as the tapered barrel cam rollers 2222 traverse around the cylindrical cam components 1200 and 1201 as the engine operates.

As depicted in FIGS. 3(*a*1)-3(*d*2), the manifold assembly 1300 may be attached to the hollow cylindrical component 1010 and positioned around the rotating cylinder 2100 adjacent to the manifold port apertures 2130. Manifold assembly 1300 is not connected to rotating cylinder 2100 so that rotating cylinder 2100 may rotate as manifold assembly 1300 remains stationary. The manifold assembly may be positioned such that as the rotating cylinder 2100 rotates, at times the manifold port apertures 2130 line up with the slots 1350, creating a single channel extending between the two components, and at other times, the manifold port apertures 2130 line up with the solid portions of the manifold assembly 1300. When the slots 1350 and the manifold port apertures 2130 at least partially line up, there may be an open path for air to travel from the inside of the rotating cylinder 2100 to outside of the hollow cylinder component 1010.

The integrated unit direct injection system 2300, as depicted in FIGS. 4(*c*1) and 4(*c*2) may be disposed around the rotating cylinder 2100 and the nozzles 2241 inserted into the fuel injection port apertures 2120. Other portions of the unit direction injection system 2300 may be attached to the hollow cylindrical component 1010 (not shown) of the stationary engine case 1000 (not-shown).

3. Operation of the Engine

Figure 2:
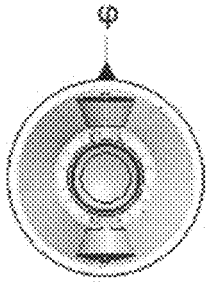
Figure 2:
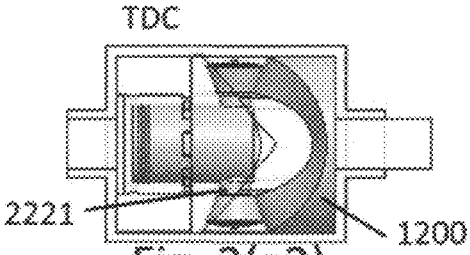
Figure 2:
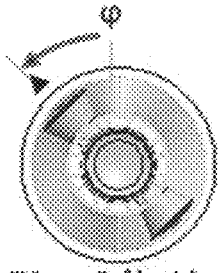
Figure 2:
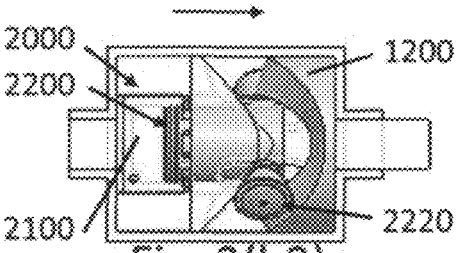
Figure 2:
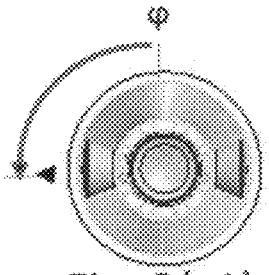
Figure 2:
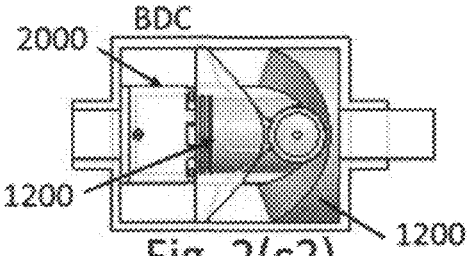
Figure 2:
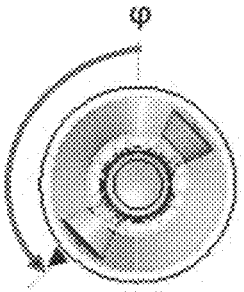
Figure 2:
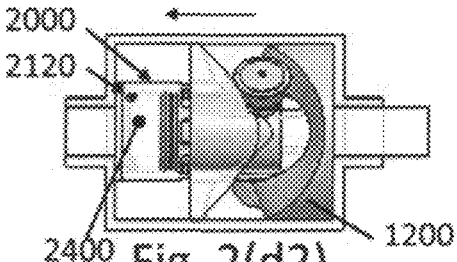

FIGS. 2(*a*1)-2(*d*2) illustrate the operation of a single cylinder, single piston engine configuration of the present invention over one complete piston cycle, or one-half of a full cylinder rotation, the cylinder rotation being counterclockwise. FIGS. 2(*a*1) through 2(*d*2) illustrate the relative position of the cylinder, piston, and manifold ports at approximately 45 degree increments. Cylinder angle phi is indicated by the small triangle and arrowed arc.

In FIGS. 2(*a*1) and 2(*a*2), the piston is shown at "Top Dead Center," or TDC. Fuel may be injected through fuel injection port apertures 2120 and ignition accomplished through methods well known in the art (i.e. spark ignition or compression ignition). When ignition occurs, reciprocating piston assembly 2200 is pushed down the rotating cylinder 2100, forcing the barrel cam rollers 2220 to follow the sinusoidal cam paths of cylindrical cam components 1200 and 1201, imparting a rotational moment upon the reciprocating piston assembly 2200. This rotational moment within reciprocating piston assembly 2200 is then transferred from the straight roller elements 2221 on the barrel cam rollers 2220 into the rotating cylinder 2100 through the cam path apertures 2110 in the rotating cylinder 2100, thereby creating a rotational motion within the entire rotating cylinder assembly 2000.

FIGS. 2(*b*1) and 2(*b*2) depict the resulting positions of the reciprocating piston assembly 2200 and rotating cylinder 2100 after the reciprocating piston 2210 has travelled half way down its path within the rotating cylinder 2100 during its combustion stroke and the resultant rotating cylinder assembly 2000 rotation of 45 degrees.

FIGS. 2(*c*1) and 2(*c*2) depict the resulting positions of the of the reciprocating piston assembly 2200 and rotating cylinder assembly 2000 after the piston has travelled all the way down the rotating cylinder 2100 to its "Bottom Dead Center," or BDC, position and the resultant rotating cylinder assembly 2000 rotation of 90 degrees. As the reciprocating piston 2210 approaches, reaches, and departs its BDC position, it uncovers the manifold port apertures 2130 within the rotating cylinder 2100 thereby allowing exhaust gases to escape the cylinder and intake air to enter the cylinder (further description provided below). Upon reaching BDC, the reciprocating piston assembly 2200 is forced back up the rotating cylinder 2100 toward TDC through its rotational inertia and the cam path constraints formed by cylindrical cam components 1200 and 1201.

FIGS. 2(*d*1) and 2(*d*2) depict the resulting positions of the reciprocating piston assembly 2200 and the rotating cylinder assembly 2000 after the reciprocating piston 2210 has travelled half way back up its path toward TDC and the resultant rotating cylinder assembly 2000 rotation of 135 degrees. During the piston's travel toward TDC, any air in the combustion chamber 2400 is compressed for the next ignition and combustion cycle upon reaching TDC, occurring at a rotating cylinder assembly 2000 rotation of 180 degrees.

4. Oil Channels

As with most internal combustion engines, the embodiments of this invention require the application of oil to bearing surfaces in order to assist the engine operating in an efficient and cool manner. The application of oil to bearing surfaces and other surfaces where friction occurs is accomplished through the addition of oil channels into the key components. Further, as is well understood in the art, the oil may be applied under pressure so as to force the oil through the various oil channels, create a constant flow of oil through the system, and provide hydrostatic oil pressure to bearing surfaces.

Figure 8:
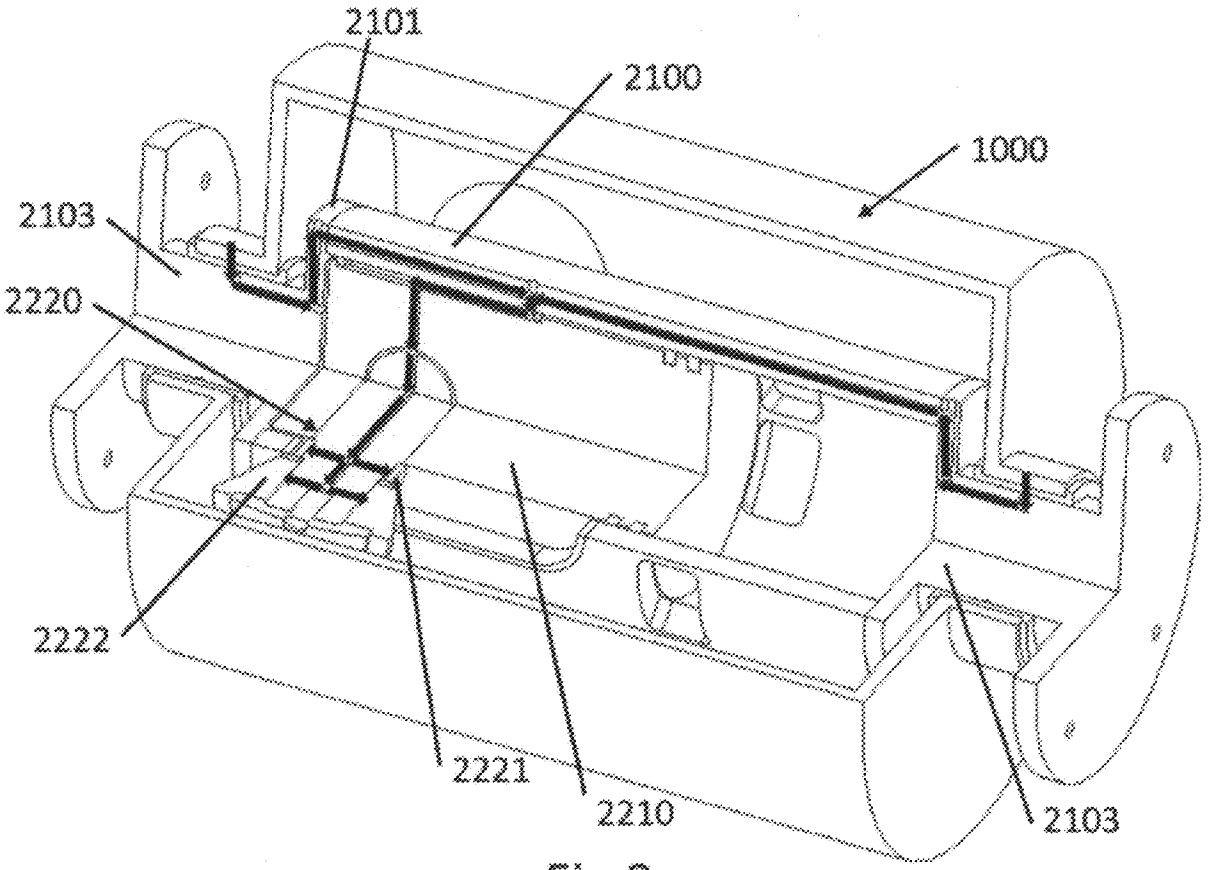
FIG. 8 illustrates a potential oil channel arrangement of the disclosed invention.

In one example, as shown in FIG. 8, the driveshaft 2103 contains a hollow oil channel running lengthwise through it. This hollow oil channel may connect to hollow oil channels that run radially from near the center of end caps 2101 toward the edge of the end caps. Near the edge, the hollow oil channels of end caps 2101 may connect with hollow oil channels in rotating cylinder 2100. The hollow oil channels in rotating cylinder 2100 may run lengthwise through the wall toward the opposite driveshaft 2103.

In some examples, the hollow oil channels of rotating cylinder 2100 may contain exit channels that extend inward toward the hollow center of the cylinder. As the oil exits these exit channels, the oil may lubricate the inner surface of the rotating cylinder 2100 and the outer surface of reciprocating piston 2210. Reciprocating piston 2210 may further have one or more shallow grooves running lengthwise carved into it. In some embodiments, the grooves start near the end of the piston opposite the end with the piston rings. The grooves may run about halfway down the piston. In other embodiments, the grooves may be shorter or longer than half the length of the piston 2210. The end of each groove may end in a channel cut into the piston 2210. The channel may extend radially inward toward the center of the piston 2210. These channels may intersect with the round slot of piston 2210 previously described. As the oil exits into the cavity between the piston 2210 and the inner wall of the rotating cylinder 2100, the grooves of the piston 2210 may collect the oil and direct it toward the round slot or slots.

The pin element that may connect the barrel cam rollers 2220 to the reciprocating piston 2210 may also contain oil channels. As the oil is directed towards the round slot of the piston 2210, the oil may enter the oil channels cut into the pin element. The oil channels in the pin element may further align with oil channels in the straight roller elements 2221 and the tapered barrel cam roller elements 2222. Each of the straight roller elements 2221 and tapered barrel cam roller elements 2222 may contain oil exit ports. As the oil may exit through the ports in the straight roller elements 2221, the oil may lubricate surfaces where the straight roller elements 2221 move against the wall of the rotating cylinder 2100 in the slotted cam path apertures 2110. As the oil may exit the tapered barrel cam roller elements 2222, the oil may lubricate both the outer surface of the tapered barrel cam roller elements 2222 and the surfaces of the cylindrical cam components 1200 and 1201. A person of ordinary skill in the art would know to arrange engine case assembly 1000 in such a manner as to collect the circulating oil in an oil pan or other similar reservoir and recirculate it through traditional pump and filter assemblies.

FIG. 8 provides a single example of how oil channels may be implemented in an engine of the present invention. FIG. 8 illustrates a portion of the engine cut-away with the oil channels highlighted in black. Other embodiments may have oil channels in different locations or connecting through different elements.

FIG. 3 illustrates a means by which exhaust gases can be scavenged from the rotating cylinder 2100 and intake air can be reintroduced into the cylinder. FIG. 3(*a*1) is an isometric depiction of the stationary manifold assembly 1300 with respect to the other engine components, while FIG. 3(*a*2) is the same isometric depiction with a portion of the manifold assembly 1300 cut away for clarity, revealing frusto-pyramidal shaped slots 1350.

FIGS. 3(*b*1) and 3(*b*2) show the reciprocating piston assembly 2200 in a position just prior to bottom dead center, with the manifold port apertures 2130 in the rotating cylinder 2100 uncovered and lined up with some of the frusto-pyramidal shaped slots 1350 in the manifold assembly 1300, thereby allowing the exhaust gases in the rotating cylinder 2100 to escape from the cylinder.

Upon further rotation of the rotating cylinder assembly 2000, the manifold port apertures 2130 in the rotating cylinder 2100 line up partially with all of the frusto-pyramidal shaped slots 1350 in the manifold assembly 1300, as depicted in FIG. 3(*c*1) and FIG. 3(*c*2), showing the rotating cylinder 2100 at 90 degrees and the reciprocating piston assembly 2200 at BDC. In this configuration, the exhaust gases continue to escape out the frusto-pyramidal shaped slots 1350 in the manifold assembly 1300 while intake air is also allowed to enter the rotating cylinder 2100, scavenging exhaust gases further.

Finally, as the rotating cylinder assembly 2000 continues to rotate and as the reciprocating piston assembly 2200 moves back up the rotating cylinder 2100 away from BDC, as shown in FIGS. 3(*d*1) and 3(*d*2), the manifold port apertures 2130 in the rotating cylinder 2100, just prior to being covered back up by the reciprocating piston 2210, line up primarily with the some of the frusto-pyramidal shaped slots 1350 in the manifold assembly 1300, allowing intake air to fill the rotating cylinder 2100. The intake air may be supplied by a supercharger and/or turbocharger, or by other methods well known in the art.

5. Operation of Further Embodiments

Figure 5:
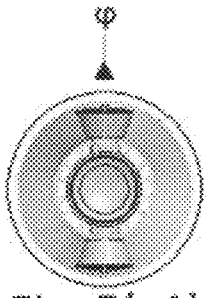
Figure 5:
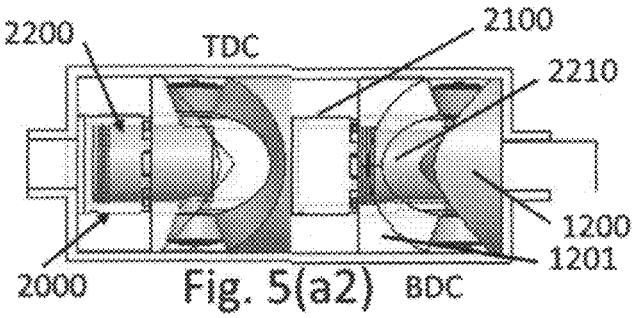
Figure 5:
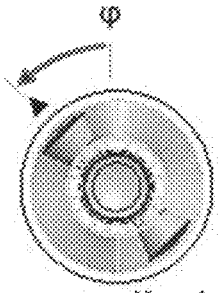
Figure 5:
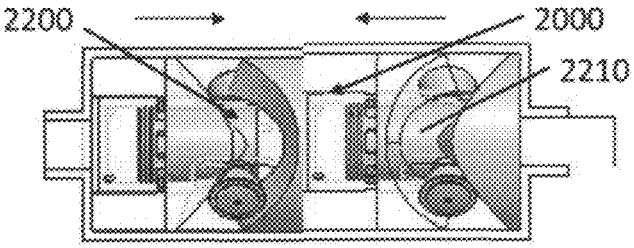
Figure 5:
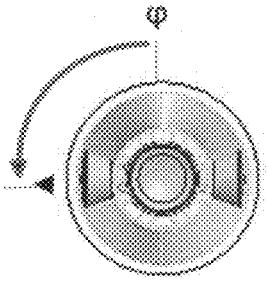
Figure 5:
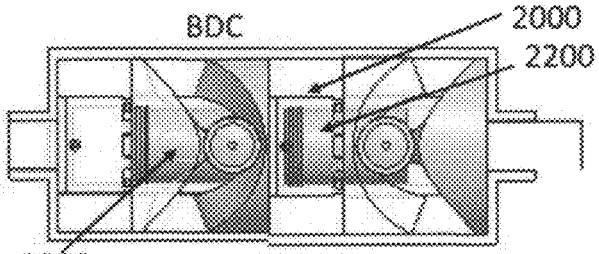
Figure 5:
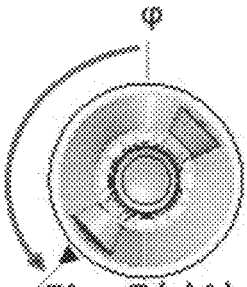
Figure 5:
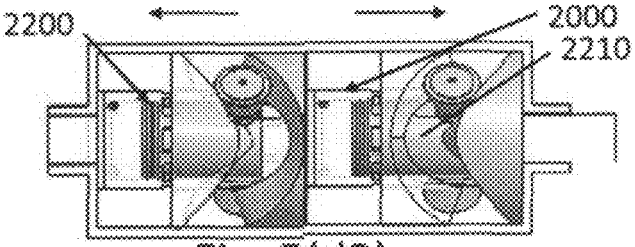

FIGS. 5(*a*1)-5(*d*2) illustrate a second embodiment of the present invention. The figures describe a dual combustion chamber, two piston engine configuration of the present invention arranged in a coaxial and tandem manner over one complete piston cycle, or one-half of a full cylinder rotation, the cylinder rotation being counterclockwise.

One advantage of this embodiment is that the forces created by the reciprocation of the piston assemblies can be dynamically balanced by having the two reciprocating piston assemblies reciprocate in opposite directions.

As shown in FIGS. 5(*a*1)-5(*d*2), the two reciprocating piston assemblies 2200 are configured as previously described herein and are arranged along a single axis and in a tandem manner. Each of the reciprocating piston assemblies 2200 are set in the same orientation. The two left-most cylindrical cam components 1200 and 1201 would, however, be shifted in phase from the two right-most cylindrical cam components 1200 and 1201 to force the second reciprocating piston 2210 to reciprocate in exact opposition to the motion of the first reciprocating piston 2210.

FIGS. 5(*a*1) and 5(*a*2) show a starting position of the rotating cylinder assembly 2000, with the left reciprocating piston 2210 at TDC and the right reciprocating piston 2210 at BDC.

FIGS. 5(*b*1) and 5(*b*2) show the relative position of the rotating cylinder assembly 2000 after 45 degrees of rotation, with the left reciprocating piston 2210 moving rightward toward the other reciprocating piston assembly 2200 from TDC toward BDC due to its combustion phase and the right reciprocating piston 2210 moving leftward toward the other reciprocating piston assembly 2200 from BDC toward TDC.

FIGS. 5(*c*1) and 5(*c*2) show the relative position of the rotating cylinder assembly 2000 after 90 degrees of rotation, positioning the left piston 2210 at BDC and the right piston 2210 at TDC.

FIGS. 5(*d*1) and 5(*d*2) show the relative position of the rotating cylinder assembly 2000 after 135 degrees of rotation, with the left reciprocating piston 2210 moving leftward away from the other reciprocating piston assembly 2200 from BDC toward TDC and the right reciprocating piston 2210 moving rightward away from the other reciprocating piston assembly 2200 from TDC toward BDC due to its combustion phase. This embodiment is dynamically balanced and has no significant side loads on the pistons, unlike modern internal combustion engines, and has four power strokes per cylinder revolution, thereby providing very smooth engine power.

Figure 6:
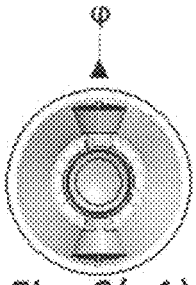
Figure 6:
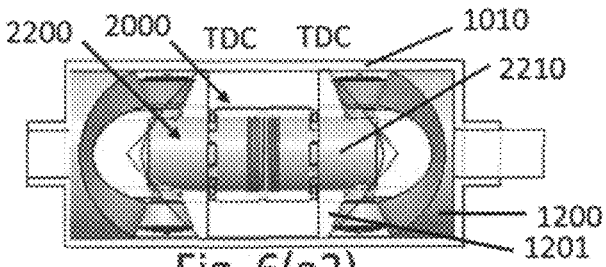
Figure 6:
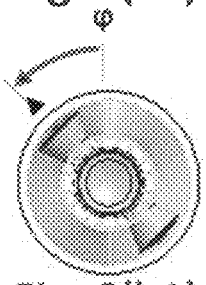
Figure 6:
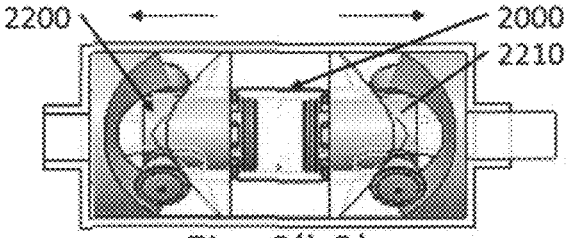
Figure 6:
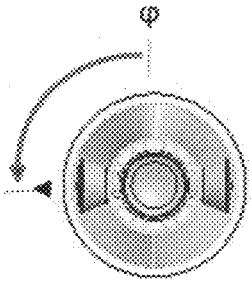
Figure 6:
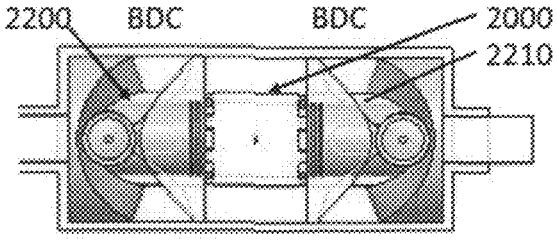
Figure 6:
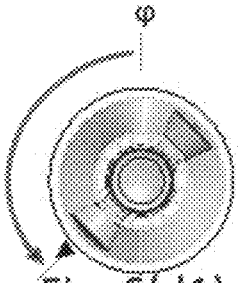
Figure 6:
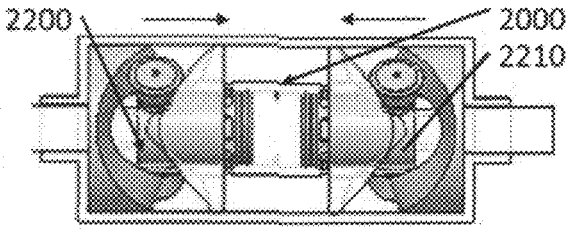

Another embodiment of the present invention is illustrated in FIGS. 6(*a*1)-6(*d*2). This embodiment has a single rotating cylinder assembly 2000, two reciprocating piston assemblies 2200, and a single combustion chamber. The figures feature a single rotating cylinder assembly 2000 and opposed reciprocating piston assemblies 2200, where the reciprocating piston assemblies 2200 are the reciprocating piston assemblies previously disclosed herein. Further, the reciprocating piston assemblies 2200 are opposed in a mirrored fashion. The space between the reciprocating pistons 2210 forms a single combustion chamber. The mirroring of the second reciprocating piston assembly 2200 (the reciprocating piston assembly 2200 on the right hand portion of the images) provides cylindrical cam components 1200 and 1201 disposed about the second reciprocating piston assembly 2200 which are shifted in phase from the cylindrical cam components 1200 and 1201 disposed about the first reciprocating piston assembly 2200 (the reciprocating piston assembly 2200 on the left hand portion of the images), forcing the second reciprocating piston assembly 2200 to reciprocate in exact opposition to the motion of the first reciprocating piston assembly 2200. FIGS. 6(*a*1)-6(*d*2) illustrate the operation of such a single cylinder, opposed piston engine configuration of the present invention over one complete piston cycle, or one-half of a full cylinder rotation, the cylinder rotation being counterclockwise. Similar to the embodiment described in FIGS. 5(*a*1)-5(*d*2), the present embodiment also results in dynamically balanced forces.

FIGS. 6(*a*1) and 6(*a*2) show a starting position of the rotating cylinder assembly 2000, with the reciprocating piston assemblies 2200 at TDC.

FIGS. 6(*b*1) and 6(*b*2) show the relative position of the rotating cylinder assembly 2000 and reciprocating piston assemblies 2200 after 45 degrees of rotation, with both reciprocating pistons 2210 moving in opposite directions from their respective TDC positions toward their respective BDC positions due to the engine's combustion phase.

FIGS. 6(*c*1) and 6(*c*2) show the relative position of the rotating cylinder assembly 2000 and reciprocating piston assemblies 2200 after 90 degrees of rotation, positioning the reciprocating pistons 2210 at BDC.

FIGS. 6(*d*1) and 6(*d*2) show the relative position of the rotating cylinder assembly 2000 and reciprocating piston assemblies 2200 after 135 degrees of rotation, with both reciprocating pistons 2210 moving toward one another from their respective BDC positions toward their respective TDC positions.

Figure 7:
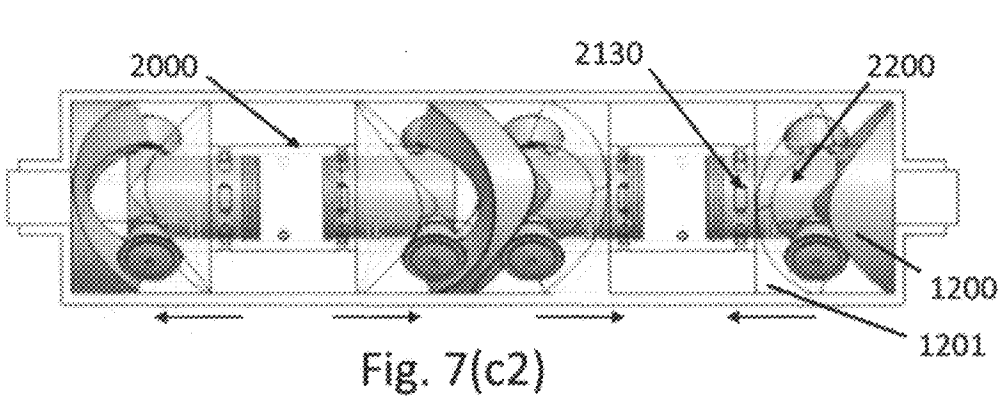
Figure 7:
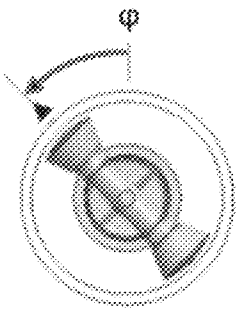
Figure 7:
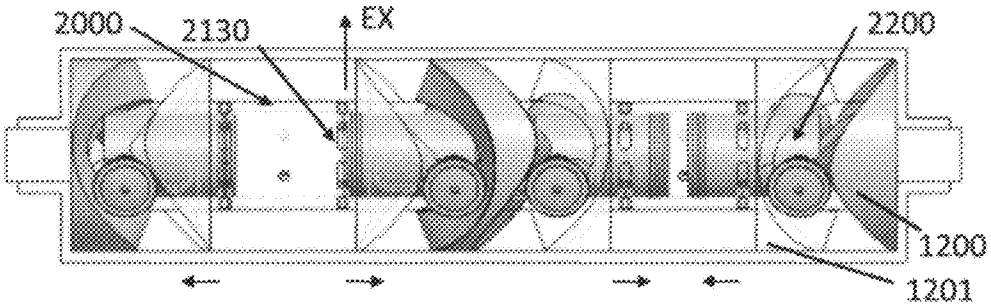
Figure 7:
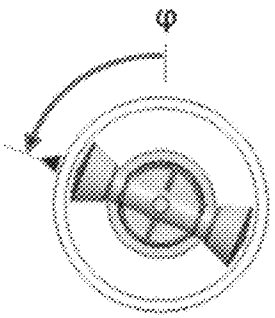
Figure 7:
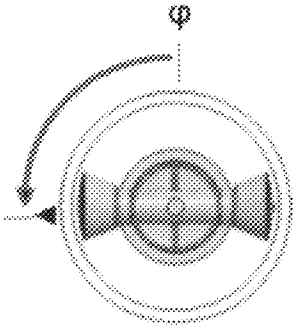
Figure 7:
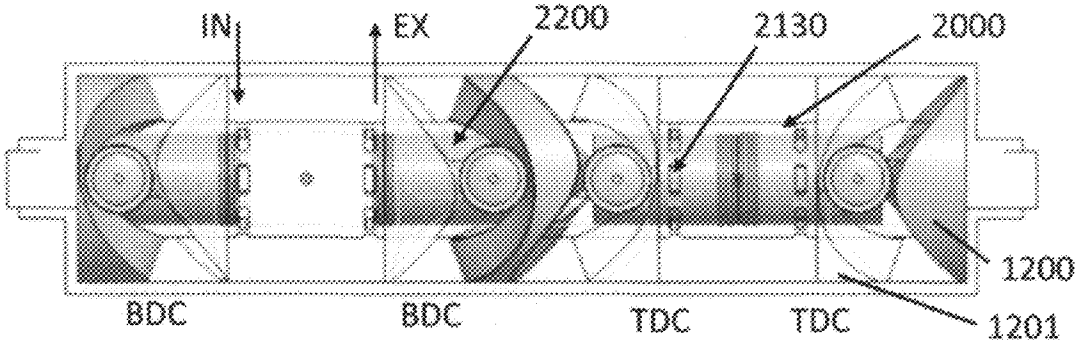
Figure 7:
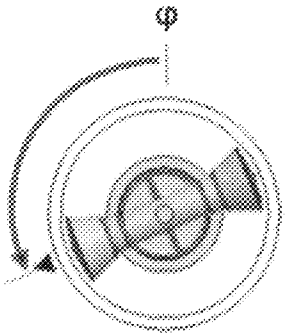
Figure 7:
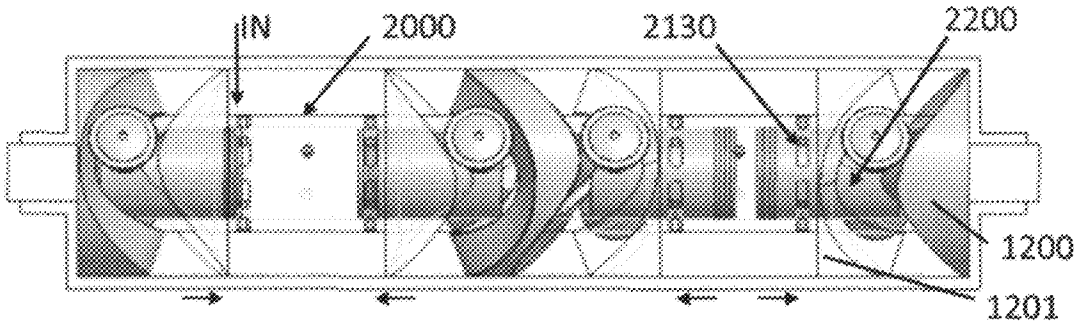
Figure 7:
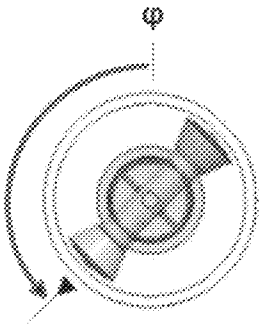
Figure 7:
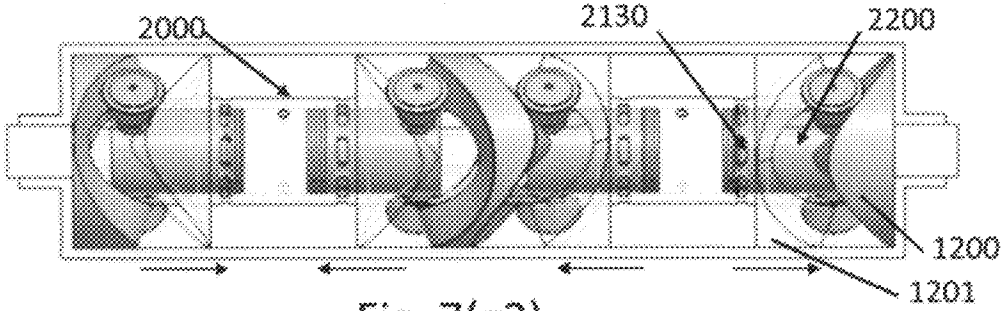
Figure 7:
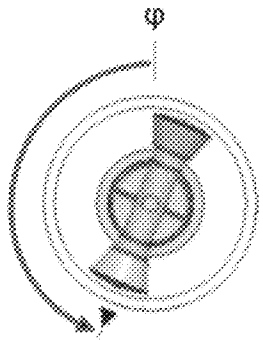
Figure 7:
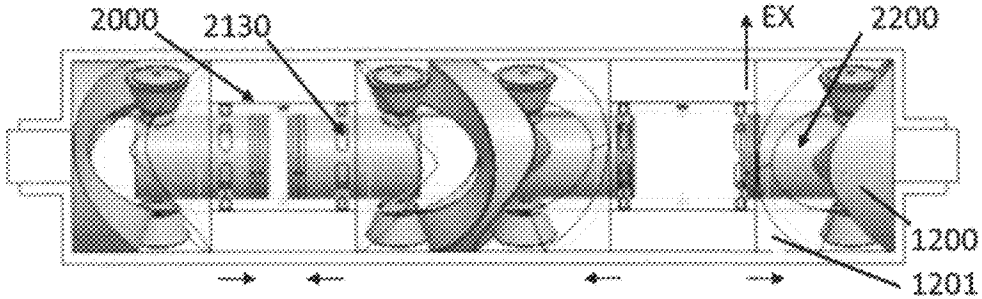

FIGS. 7(*a*1)-7(*h*2) illustrate another embodiment of the present invention. The figures describe a single cylinder dual opposed piston engine configuration. This embodiment utilizes two of the previously disclosed single cylinder opposed piston engine configurations, arranged in a coaxial and tandem but rotated manner. The figures illustrates the operation of one embodiment of the engine over one complete piston cycle, or one-half of a full cylinder rotation, the cylinder rotation being counterclockwise.

Each side of the rotating cylinder assembly 2000 has two sets of manifold port apertures 2130 formed near the end of each reciprocating piston 2210 and fuel injection port apertures 2120 between the two sets of manifold port apertures 2130 in communication with the combustion chamber. In one particular embodiment of this general engine type, each set of manifold port apertures 2130 may be responsible for either the intake or air only or the exhausting of air only. In such an embodiment, the reciprocating pistons 2210 cover and uncover their respective manifold port apertures 2130 during engine operation allowing air passages to close and open, respectively to control the flow of intake or exhaust gasses. This configuration not only allows for effective exhaust scavenging, but also permits independent, asymmetric timing of the intake and exhaust ports, and is presumed to be more efficient in scavenging exhaust, pressurizing intake air, and avoiding unnecessary and inefficient mixing of the two. Accordingly, each of the manifold assemblies 1300 may be responsible for handling either intake or exhaust, but not both.

Another unique aspect to this particular embodiment of the invention over the previously described embodiments is the shape and configuration of the cylindrical cam components 1200 and 1201. One example of this embodiment may use another cylindrical cam component 1203 between the two sets of reciprocating piston assemblies 2200. Cylindrical cam component 1203 may have two curvilinear surfaces opposite each, each of which interacts with barrel cam rollers 2220. Another difference is that the phasing (the variation in where the peaks of one component rise and the valleys of the opposing component fall) of the cylindrical cam components for each cylinder may be arranged so that the manifold port apertures 2130 responsible for exhausting air open before the manifold port apertures 2130 responsible for air intake open and close before its intake manifold port apertures close. Instead of adjusting the phasing to accomplish this asymmetric timing, other embodiments may position the manifold port apertures 2130 at different positions relative to the reciprocating pistons 2210 such that the manifold ports 2130 responsible for exhaust open first after combustion relative to the manifold ports 2130 responsible for intake. This asymmetric timing makes it possible to utilize superchargers and/or turbochargers to enhance engine efficiency, and some embodiments take advantage of this possibility and do use superchargers, turbochargers, or both. The asymmetric timing further increase efficiency beyond the possibility of using superchargers, turbochargers, or both because: if the exhaust ports open before the intake ports, energy in the exhaust gases can be more effectively recovered by a turbocharger; if the exhaust ports close before the intake ports, the cylinder can be more effectively supercharged.

To provide the asymmetric timing while preserving the dynamic balance, one side of the rotating cylinder assembly 2000 has the manifold port apertures 2130 responsible for air intake on its inner end, while the other side of the rotating cylinder assembly 2000 has the manifold port apertures 2130 responsible for air intake on its outer end, with the mass and motion of the outer reciprocating piston assembly 2200 completely counteracted by the mass and motion of the inner reciprocating piston assembly 2200 on the opposing cylinder. In this configuration, the mass and motion of the remaining two reciprocating piston assemblies 2200 furthermore counteract each other. This results in an engine that has asymmetric timing and is yet completely dynamically balanced.

Despite the advantages of the above described embodiment with respect to asymmetric timing, other embodiments of this general engine type may have each set of manifold port apertures 2130 responsible for both the intake and exhaust of air.

FIGS. 7(*a*1) and 7(*a*2) show a starting position of the rotating cylinder assembly 2000, with the reciprocating piston assemblies 2200 on the left at approximately TDC and with reciprocating piston assemblies 2200 on the right at approximately BDC and the associated manifold port apertures 2130 open.

FIGS. 7(*b*1) and 7(*b*2) show the relative position of the rotating cylinder assembly 2000, reciprocating piston assemblies 2200, and manifold port apertures 2130 after 22.5 degrees of rotation due to the combustion phase of the left side of the rotating cylinder assembly 2000, with the left reciprocating piston assemblies 2200 moving away from one another and the right two reciprocating piston assemblies 2200 moving toward one another. Due to the phasing of the cylindrical cam components 1200 and 1201 disposed about each reciprocating piston assembly, where the cylindrical cam components on the left of each piston assembly are shifted approximately 7.5 degrees counterclockwise and the cylindrical cam components on the right of each piston assembly are shifted approximately 7.5 degrees clockwise, the reciprocating piston assemblies 2200 on the left in each cylinder will be moving at equal and opposite directions and the reciprocating piston assemblies 2200 on the right in each cylinder will be moving at equal and opposite directions. In this position, the right-most reciprocating piston assembly 2200 is covering its manifold port apertures 2130 and its corresponding opposing reciprocating piston assembly 2200 is still allowing its manifold port apertures 2130 to be uncovered so that pressurized intake air can be added to the space inside the rotating cylinder 2100.

FIGS. 7(*c*1) and 7(*c*2) show the relative position of the rotating cylinder assembly 2000, reciprocating piston assemblies 2200, and manifold port apertures 2130 after 45 degrees of rotation due to the combustion phase of the left side of the rotating cylinder assembly 2000, with the left two reciprocating piston assemblies 2200 moving away from one another and the right two reciprocating piston assemblies 2200 moving toward one another.

FIGS. 7(*d*1) and 7(*d*2) show the relative position of the rotating cylinder assembly 2000, reciprocating piston assemblies 2200, and manifold port apertures 2130 after 67.5 degrees of rotation due to the combustion phase of the left side of the rotating cylinder assembly 2000, with the left two reciprocating piston assemblies 2200 moving away from one another approaching BDC and the right two reciprocating piston assemblies 2200 moving toward one another approaching TDC. In this position, the left-most reciprocating piston assembly 2200 is covering manifold port apertures 2130 and its corresponding opposing reciprocating piston assembly 2200 is now allowing its manifold port apertures 2130 to be uncovered so the exhaust gases can be effectively scavenged.

FIGS. 7(*e*1) and 7(*e*2) show the relative position of the rotating cylinder assembly 2000, reciprocating piston assemblies 2200, and manifold port apertures 2130 after 90 degrees of rotation, with the left reciprocating piston assemblies 2200 at approximately BDC and its respective manifold port apertures 2130 open, and with the reciprocating piston assemblies 2200 on the right at approximately TDC.

FIGS. 7(*f*1) and 7(*f*2) show the relative position of the rotating cylinder assembly 2000, reciprocating piston assemblies 2200, and manifold port apertures 2130 after 112.5 degrees of rotation due to the combustion phase of the right side of the rotating cylinder assembly 2000, with the left two reciprocating piston assemblies 2200 moving toward one another and the right two reciprocating piston assemblies 2200 moving away from one another. In this position, the right reciprocating piston assembly 2200 in the left side of the rotating cylinder assembly 2000 is covering its manifold port apertures 2130 and its corresponding opposing reciprocating piston assembly 2200 is still allowing its manifold port apertures 2130 to be uncovered so that pressurized intake air can be added to the space inside rotating cylinder assembly 2000.

FIGS. 7(*g*1) and 7(*g*2) show the relative position of the rotating cylinder assembly 2000, reciprocating piston assemblies 2200, and manifold port apertures 2130 after 135 degrees of rotation due to the combustion phase of the right side of the rotating cylinder assembly 2000, with the left two reciprocating piston assemblies 2200 moving toward one another and the right two reciprocating piston assemblies 2200 moving away from one another.

FIGS. 7(*h*1) and 7(*h*2) show the relative position of the rotating cylinder assembly 2000, reciprocating piston assemblies 2200, and manifold port apertures 2130 after 157.5 degrees of rotation due to the combustion phase of the right side of the rotating cylinder assembly 2000, with the left two reciprocating piston assemblies 2200 moving toward one another and the right two reciprocating piston assemblies 2200 moving away from one another. In this position, the left reciprocating piston assembly 2200 on the right side of rotating cylinder assembly 2000 is covering manifold port apertures 2130 and its corresponding opposing reciprocating piston assembly 2200 is now allowing its manifold port apertures 2130 to be uncovered so the exhaust gases can be effectively scavenged.

The specific angles and timing depend on the stationary cylindrical cam component geometries and intake and exhaust port sizes and locations; the above description is intended solely to illustrate the concepts of the invention.

Although the preferred embodiment engine of the present invention has the same total number of pistons as a conventional four cylinder in-line engine, for a comparable power output the mean piston velocity is substantially reduced, since each piston travels a shorter distance.

FIGS. 9(*a*1)-9(*h*2) illustrate another embodiment of the present invention. The figures describe a single cylinder opposed piston engine configuration. This embodiment is similar to the embodiment depicted in FIGS. 7(*a*1)-7(*h*2), but combines the center two reciprocating piston assemblies 2200 from that previously disclosed embodiment into a single center reciprocating piston assembly 2280 with a single longer piston and only one set of barrel cam rollers. This center reciprocating piston assembly 2280 thus interacts with both the left and right combustion chambers. The figures illustrates the operation of such an embodiment of the engine over one complete piston cycle, or one-half of a full cylinder rotation, the cylinder rotation being counterclockwise.

Each side of the rotating cylinder assembly 2000 has two sets of manifold port apertures 2130 formed near the BDC position of each reciprocating piston 2210 and fuel injection port apertures 2120 between the two sets of manifold port apertures 2130 communicating with the combustion chamber. In one particular embodiment of this general engine type, each set of manifold port apertures 2130 may be responsible for either the intake of air only or the exhausting of air only. This configuration not only allows for effective exhaust scavenging, but permits independent, asymmetric timing of the intake and exhaust ports, and is presumed to be more efficient in scavenging exhaust, pressurizing intake air, and avoiding unnecessary and inefficient mixing of the two.

To provide appropriate intake and exhaust timing, one side of the rotating cylinder assembly 2000 has the manifold port apertures 2130 responsible for air intake on its inner end, while the other side of the rotating cylinder assembly 2000 has the manifold port apertures 2130 responsible for air intake on its outer end, with the mass and motion of the two outer reciprocating piston assemblies 2200 completely counteracted by the mass and motion of the center reciprocating piston assembly 2280. Such manifold and piston arrangements result in an engine that has asymmetric intake and exhaust timing and is yet completely dynamically balanced.

Despite the advantages of the above described embodiment with respect to asymmetric timing, other embodiments of this general engine type may have each set of manifold port apertures 2130 responsible for both the intake and exhaust of air.

FIGS. 9(*a*1) and 9(*a*2) show a starting position of the rotating cylinder assembly 2000, with the left reciprocating piston assembly 2200 at TDC, with the center reciprocating piston assembly 2280 at its left-most position, and with the right reciprocating piston assembly 2200 at BDC. In this position, the right two sets of manifold port apertures 2130 in the rotating cylinder 2100 are uncovered and lined up with some of the frusto-pyramidal shaped slots 1350 in the right two manifold assemblies 1300, so exhaust gases are allowed to escape through the right apertures and intake gases are allowed to enter through the left apertures.

FIGS. 9(*b*1) and 9(*b*2) show the relative position of the rotating cylinder assembly 2000, reciprocating piston assemblies 2200 and 2280, and manifold port apertures 2130 after 22.5 degrees of rotation due to the combustion phase of the left side of the rotating cylinder assembly 2000, with the outer two reciprocating piston assemblies 2200 moving leftward and the center reciprocating piston assembly 2280 moving rightward. In this position, the manifold port apertures 2130 in the rotating cylinder 2100 to the right of the center reciprocating piston assembly 2280 are uncovered and lined up with some of the frusto-pyramidal shaped slots 1350 in the manifold assembly 1300 to the right of the center reciprocating piston 2280, so that pressurized intake air can be added to the space inside the rotating cylinder 2100.

FIGS. 9(*c*1) and 9(*c*2) show the relative position of the rotating cylinder assembly 2000, reciprocating piston assemblies 2200 and 2280, and manifold port apertures 2130 after 45 degrees of rotation due to the combustion phase of the left side of the rotating cylinder assembly 2000, with the outer two reciprocating piston assemblies 2200 moving leftward and the center reciprocating piston assembly 2280 moving rightward.

FIGS. 9(*d*1) and 9(*d*2) show the relative position of the rotating cylinder assembly 2000, reciprocating piston assemblies 2200 and 2280, and manifold port apertures 2130 after 67.5 degrees of rotation due to the combustion phase of the left side of the rotating cylinder assembly 2000, with the outer two reciprocating piston assemblies 2200 moving leftward toward their left most positions and the center reciprocating piston assembly 2280 moving rightward toward its rightmost position. In this position, the manifold port apertures 2130 in the rotating cylinder 2100 to the left of the center reciprocating piston assembly 2280 are uncovered and lined up with some of the frusto-pyramidal shaped slots 1350 in the manifold assembly 1300 to the left of the center reciprocating piston 2280, so the exhaust gases from that combustion chamber can be effectively scavenged.

FIGS. 9(*e*1) and 9(*e*2) show the relative position of the rotating cylinder assembly 2000, reciprocating piston assemblies 2200 and 2280, and manifold port apertures 2130 after 90 degrees of rotation, with the left reciprocating piston assembly 2200 at BDC, with the center reciprocating piston assembly 2280 at its right-most position, and with the right reciprocating piston assembly 2200 at TDC. In this position, the left two sets of manifold port apertures 2130 in the rotating cylinder 2100 are uncovered and lined up with some of the frusto-pyramidal shaped slots 1350 in the left two manifold assemblies 1300, so exhaust gases are allowed to escape through the right apertures and intake gases are allowed to enter through the left apertures.

FIGS. 9(*f*1) and 9(*f*2) show the relative position of the rotating cylinder assembly 2000, reciprocating piston assemblies 2200 and 2280, and manifold port apertures 2130 after 112.5 degrees of rotation due to the combustion phase of the right side of the rotating cylinder assembly 2000, with the outer two reciprocating piston assemblies 2200 moving rightward and the center reciprocating piston assembly 2280 moving leftward. In this position, the left-most manifold port apertures 2130 in the rotating cylinder 2100 are uncovered and lined up with some of the frusto-pyramidal shaped slots 1350 in the left-most manifold assembly 1300, so that pressurized intake air can be added to the space inside the rotating cylinder 2100.

FIGS. 9(*g*1) and 9(*g*2) show the relative position of the rotating cylinder assembly 2000, reciprocating piston assemblies 2200 and 2280, and manifold port apertures 2130 after 135 degrees of rotation due to the combustion phase of the right side of the rotating cylinder assembly 2000, with the outer two reciprocating piston assemblies 2200 moving rightward and the center reciprocating piston assembly 2280 moving leftward.

FIGS. 9(*h*1) and 9(*h*2) show the relative position of the rotating cylinder assembly 2000, reciprocating piston assemblies 2200 and 2280, and manifold port apertures 2130 after 157.5 degrees of rotation due to the combustion phase of the right side of the rotating cylinder assembly 2000, with the outer two reciprocating piston assemblies 2200 moving rightward toward their right-most positions and the center reciprocating piston assembly 2280 moving leftward toward its left-most position. In this position, the right-most manifold port apertures 2130 in rotating cylinder 2100 are uncovered and lined up with some of the frusto-pyramidal shaped slots 1350 in the right-most manifold assembly 1300, so the exhaust gases from that combustion chamber can be effectively scavenged.

The specific angles and timing depend on the stationary cylindrical cam component geometries and intake and exhaust port sizes and locations; the above description is intended solely to illustrate the concepts of the invention.

Compared to a current state-of-the-art production four cylinder in-line engine having comparable performance, the engine of the present invention provides substantial improvements in installation suitability, the reduction of friction losses, and the elimination of vibration. Friction due to lateral forces on the pistons is greatly reduced by this design, since there are no piston rods imparting such side loads into the pistons. Furthermore, the engine of the present invention can be totally dynamically balanced. The overall volume of the engine of the present invention represents an approximately 40% reduction over a four cylinder in-line engine, with a corresponding 30% reduction in weight, and a 50% reduction in frontal area.

The above is a detailed description of particular embodiments of the invention. It is recognized that departures from the disclosed embodiments may be within the scope of this invention and that obvious modifications will occur to a person skilled in the art. It is the intent of the applicant that the invention include alternative embodiments known in the art that perform the same functions as those disclosed. This specification should not be construed to unduly narrow the full scope of protection to which the invention is entitled.

The corresponding structures, materials, acts, and equivalents of all means or step plus function elements in the following claims are intended to include any structure, material, or acts for performing the functions in combination with other claimed elements as specifically claimed.

I claim:

1. A rotatable fuel injection assembly comprising:

a nozzle assembly;

a plunger assembly including a plunger rod positioned at an angle to the nozzle assembly, wherein when the plunger is depressed, the plunger advances fuel into a high pressure fuel channel; and a fuel injector cam roller connected to the plunger, the cam roller for actuation of the plunger rod; and;

further comprising a fuel injector cam ring positioned around the fuel injection assembly, wherein the fuel injector cam roller traverses the fuel injector cam ring as the fuel injection assembly rotates, and wherein the fuel injector cam roller reciprocates the plunger rod as the fuel injector cam rollers traverse the fuel injector cam ring.

2. The rotatable fuel injection assembly of claim 1 further comprising an electrical slip ring.

3. The rotatable fuel injection assembly of claim 1 further comprising rotary fluid coupling.

4. An internal combustion engine, comprising:

a stationary engine case assembly having cylindrical cam components;

a rotatable cylinder being disposed within the engine case and spaced apart from the cam components, the cylinder having a cylinder wall, a plurality of intake/exhaust port apertures and at least one fuel injection port being defined through the cylinder wall and at least one cam path aperture being defined through the cylinder wall;

at least a first pair of pistons reciprocably disposed in a cylinder and defining a combustion chamber directly between each respective pair of pistons;

the cylinder and having at least one cam roller operably coupled to each piston of the respective pair of pistons along an axis extending toward a center of the piston;

a respective cam roller extending through a respective cam path aperture defined in the cylinder and engaging a cam path defined by the cam components, the cam roller imparting rotation to the cylinder responsive to reciprocation of the piston; and including a fuel injection system including a fluid coupling and an electrical slip ring, an inner portion thereof being rotatable with the cylinder and an outer portion thereof being in stationary coupling with the engine case.

5. The engine of claim 4 including at least a first fuel injector in fluid communication with a respective fuel injection port and in fluid and electrical communication with the fluid coupling and the electrical slip ring respectively, the fuel injector for elevating the pressure of the fuel received from the fluid coupling under influence of electrical commands received from the electrical slip ring.

6. An internal combustion engine, comprising:

a stationary engine case assembly having cylindrical cam components;

a rotatable cylinder being disposed within the engine case and spaced apart from the cam components, the cylinder having a cylinder wall, a plurality of intake/exhaust port apertures and at least one fuel injection port being defined through the cylinder wall and at least one cam path aperture being defined through the cylinder wall;

at least a first pair of pistons reciprocably disposed in a cylinder and defining a combustion chamber directly between each respective pair of pistons;

the cylinder and having at least one cam roller operably coupled to each piston of the respective pair of pistons along an axis extending toward a center of the piston;

a respective cam roller extending through a respective cam path aperture defined in the cylinder and engaging a cam path defined by the cam components, the cam roller imparting rotation to the cylinder responsive to reciprocation of the piston; and including a manifold assembly disposed within the engine case, the manifold assembly having a centrally disposed circular aperture defined therein and a plurality of slots extending from a circumference of the manifold assembly to the centrally disposed circular aperture, a respective manifold slot being selectively alignable with a respective one of the plurality of intake/exhaust port apertures.

7. An internal combustion engine comprising:

an engine case;

at least a first rotatable cylinder at least partially disposed within the engine case;

one or more cam components, the cam components being connected to the engine case, wherein the one or more cam components are disposed around a portion of the rotatable cylinder;

at least a first pair of opposed reciprocatable pistons being at least partially disposed within the rotatable cylinder, each of the pair of reciprocatable pistons being reciprocable in opposition to one other, a compression reciprocating motion being under the influence of a respective cam component associated with each respective piston, and a single combustion chamber being defined between the two pistons of each pair of opposed reciprocable pistons;

one or more cam path apertures defined through the wall of the rotating cylinder;

one or more cam rollers, each cam roller being connected to a one of the reciprocatable pistons and extending through a respective cam path apertures and residing in part within a cam path defined by the respective cam component, and;

a rotating fuel injection assembly having a nozzle positioned adjacent to a fuel injection port;

a high pressure fuel channel configured to withstand high pressure connected to the nozzle;

a valve positioned between the high pressure fuel channel configured to withstand high pressure and the nozzle;

a plunger rod positioned at an angle to the nozzle, wherein when the plunger rod is depressed, the plunger rod pushes fuel into the high pressure fuel channel configured to withstand high pressure; and a fuel injector cam roller connected to the plunger rod.

8. The internal combustion engine of claim 7 further comprising a fuel injector cam ring positioned around the fuel injection assembly, wherein the fuel injector cam roller traverses the fuel injector cam ring as the fuel injection assembly rotates, and wherein the fuel injector cam roller reciprocates the plunger rod as the fuel injector cam rollers traverse the fuel injector cam ring.

9. The internal combustion engine of claim 7 wherein the rotating fuel injection assembly further comprises an electrical slip ring.

10. The internal combustion engine of claim 7 wherein the rotating fuel injection assembly further comprises a rotary fluid coupling.

* * * * *